US011821163B2

(12) United States Patent
Sano

(10) Patent No.: US 11,821,163 B2
(45) Date of Patent: Nov. 21, 2023

(54) SHOVEL

(71) Applicant: SUMITOMO HEAVY INDUSTRIES, LTD., Tokyo (JP)

(72) Inventor: Yusuke Sano, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 452 days.

(21) Appl. No.: 16/998,246

(22) Filed: Aug. 20, 2020

(65) Prior Publication Data

US 2021/0054595 A1 Feb. 25, 2021

(30) Foreign Application Priority Data

Aug. 21, 2019 (JP) ..... 2019-151275

(51) Int. Cl.
*E02F 3/90* (2006.01)
*E02F 9/20* (2006.01)

(52) U.S. Cl.
CPC ..... *E02F 3/907* (2013.01); *E02F 9/2004* (2013.01)

(58) Field of Classification Search
CPC ... E02F 9/264; E02F 9/24; E02F 3/907; E02F 9/2282
See application file for complete search history.

(56) References Cited

U.S. PATENT DOCUMENTS 6,518,519 B1 * 2/2003 Crane, III ..... E02F 9/264 177/136
2008/0319710 A1 * 12/2008 Hsu ..... G01G 19/083 702/174
2009/0139119 A1 * 6/2009 Janardhan ..... G01G 19/021 37/413

FOREIGN PATENT DOCUMENTS

| | | | |
|---|---|---|---|
| JP | H01-079621 | 3/1989 | |
| JP | H07-259137 | 10/1995 | |
| JP | H10-245874 | 9/1998 | |
| JP | H11-230821 | 8/1999 | |
| JP | 2012-111581 | 6/2012 | |
| JP | 2018-145754 | 9/2018 | |
| JP | 2018-154976 | 10/2018 | |
| JP | 2018154976 A * | 10/2018 | ..... E02F 9/26 |

* cited by examiner

*Primary Examiner* — Abiy Teka
(74) *Attorney, Agent, or Firm* — IPUSA, PLLC

(57) ABSTRACT

A shovel includes an attachment attached to an upper turning body and a processor configured to calculate a weight of a load carried in the attachment in accordance with a mode selected from a plurality of modes with respect to timing of detection.

5 Claims, 13 Drawing Sheets

SHOVEL

CROSS-REFERENCE TO RELATED APPLICATIONS

The present application is based on and claims priority under 35 U.S.C. § 119 from Japanese Patent Application No. 2019-151275, filed Aug. 21, 2019, the content of which is incorporated herein by reference in their entirety.

BACKGROUND

Technical Field

The present disclosure relates to a shovel.

Description of Related Art

A method for detecting the earth load in a bucket during boom raising operation or turning operation is known.

SUMMARY

According to an aspect of the present disclosure, a shovel includes an attachment attached to an upper turning body and a processor configured to calculate a weight of a load carried in the attachment in accordance with a mode selected from a plurality of modes with respect to timing of detection.

EMBODIMENT OF THE INVENTION

A method for detecting the earth load carried in a bucket while a boom is being raised and while an excavating machine is being turned is known. For example, for an excavating machine including a boom, a stick, and a bucket, a method for deriving a load carried in the bucket according to a boom speed and a stick speed is disclosed.

However, depending on the task of the shovel, the shovel may unload the earth without appreciably raising the boom (for example, the shovel may unload the earth to a dump truck waiting on a surface lower than the ground on which the shovel rests) and the shovel may unload the earth without appreciably turning (for example, the shovel may unload the earth by turning only about 45 degrees from the excavation position). Because such task involves almost no boom raising operation or turning operation, it may be difficult to detect the earth weight during such task.

Accordingly, in view of the above problem, it is desired to achieve a shovel configured to calculate the weight of a load with a high accuracy.

Hereinafter, an embodiment for carrying out the present invention will be described with reference to drawings.

[Overview of Shovel]

First, overview of a shovel 100 according to the present embodiment is hereinafter explained with reference to FIG. 1.

Figure 1:
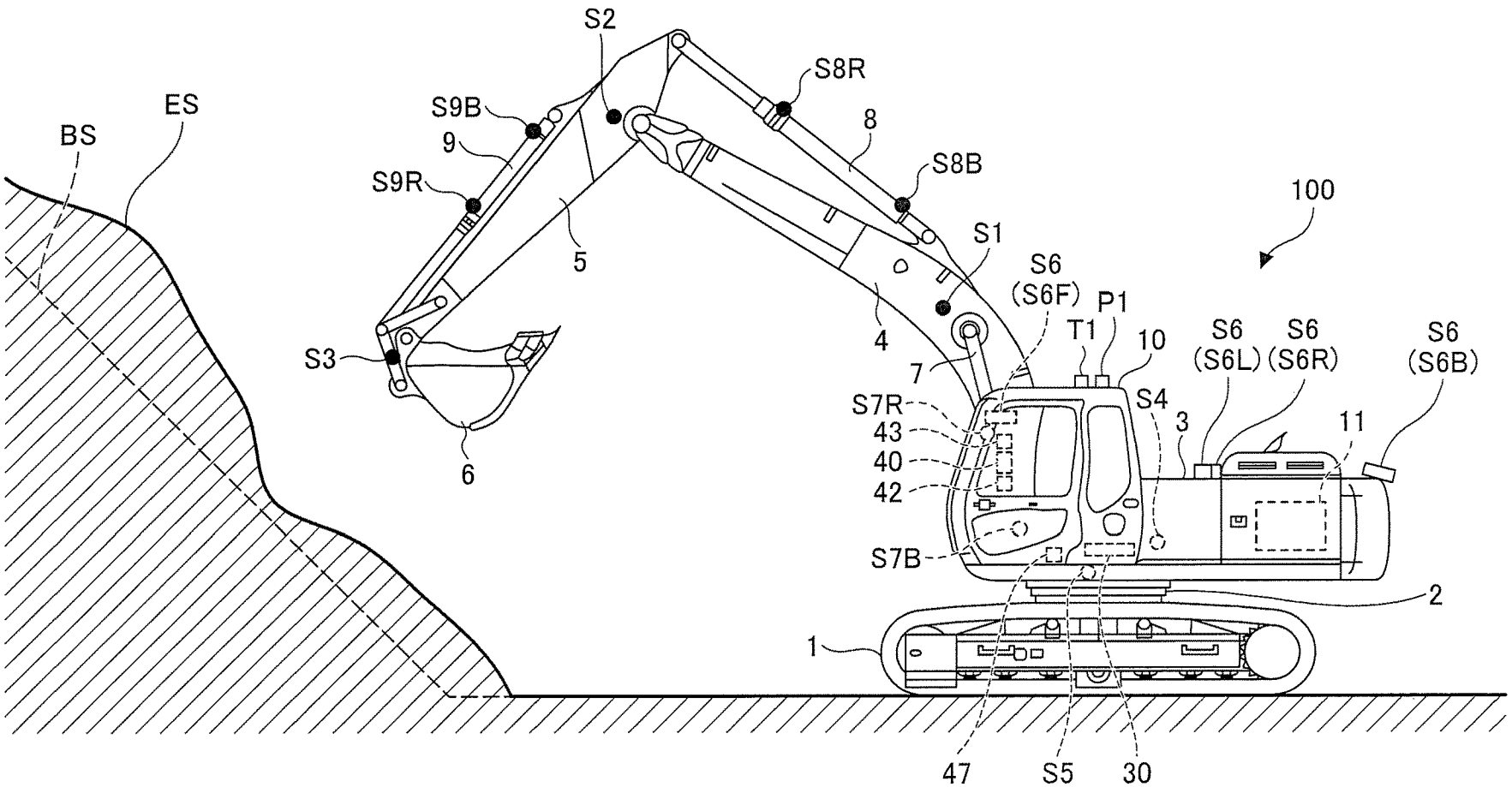
FIG. 1 is a side view of a shovel (i.e., an excavator) according to the present embodiment.

FIG. 1 is a side view of a shovel 100 (i.e., an excavator) according to the present embodiment.

In FIG. 1, the shovel 100 is located on a horizontal surface adjacent to an original ascending slope ES which is to be excavated, and FIG. 1 also illustrates a finished ascending slope BS (i.e., a finished slope shape which is constructed as a result of excavation, in contrast to the original ascending slope ES). The finished ascending slope BS is an example of an excavation target surface explained later. The original ascending slope ES, which is to be excavated, is provided with cylindrical bodies (not illustrated) indicating a direction normal to the finished ascending slope BS, i.e., the excavation target surface.

The shovel 100 according to the present embodiment includes a lower traveling body 1, an upper turning body 3 pivotally mounted on the lower traveling body 1 with a turning mechanism 2, a boom 4, an arm 5, a bucket 6, and a cab 10. The boom 4, the arm 5, and the bucket 6 constitute an attachment (working machine).

The lower traveling body 1 includes, for example, a pair of right and left crawlers. The crawlers are hydraulically driven by a pair of right and left traveling hydraulic motors 1L, 1R (see FIG. 2) to cause the shovel 100 to travel. In other words, the pair of traveling hydraulic motors 1L, 1R (an example of a traveling motor) drive the lower traveling body 1 (crawler) serving as a driven unit.

The upper turning body 3 is driven by a turning hydraulic motor 2A (see FIG. 2 explained later) to turn with respect to the lower traveling body 1. In other words, the turning hydraulic motor 2A is a turning driving unit for driving the upper turning body (i.e., a driven unit), and can change the direction of the upper turning body 3.

It should be noted that the upper turning body 3 may be electrically driven by a motor (hereinafter "turning motor") instead of being driven by the turning hydraulic motor 2A. In other words, like the turning hydraulic motor 2A, the turning motor is a turning driving unit for driving the upper turning body 3 (i.e., a driven unit), and can change the direction of the upper turning body 3.

The boom 4 is pivotally attached to the front center of the upper turning body 3 to be able to vertically pivot. The arm 5 is pivotally attached to the end of the boom 4 to be able to pivot vertically. The bucket 6 (i.e., an end attachment) is pivotally attached to the end of the arm 5 to be able to pivot vertically. The boom 4, the arm 5, and the bucket 6 are hydraulically driven by a boom cylinder 7, an arm cylinder 8, and a bucket cylinder 9, respectively, serving as hydraulic actuators.

It should be noted that the bucket 6 is an example of an end attachment. According to the content of task and the like, instead of the bucket 6, other end attachments such as, for example, a slope finishing bucket, a dredging bucket, a breaker, and the like may be attached to the end of the atm 5.

The cab 10 is an operation room in which the operator rides, and is mounted on the front left of the upper turning body 3.

[Basic Configuration of Shovel]

Next, a specific configuration of the shovel 100 according to the present embodiment is explained with reference to not only FIG. 1 but also FIG. 2.

Figure 2:
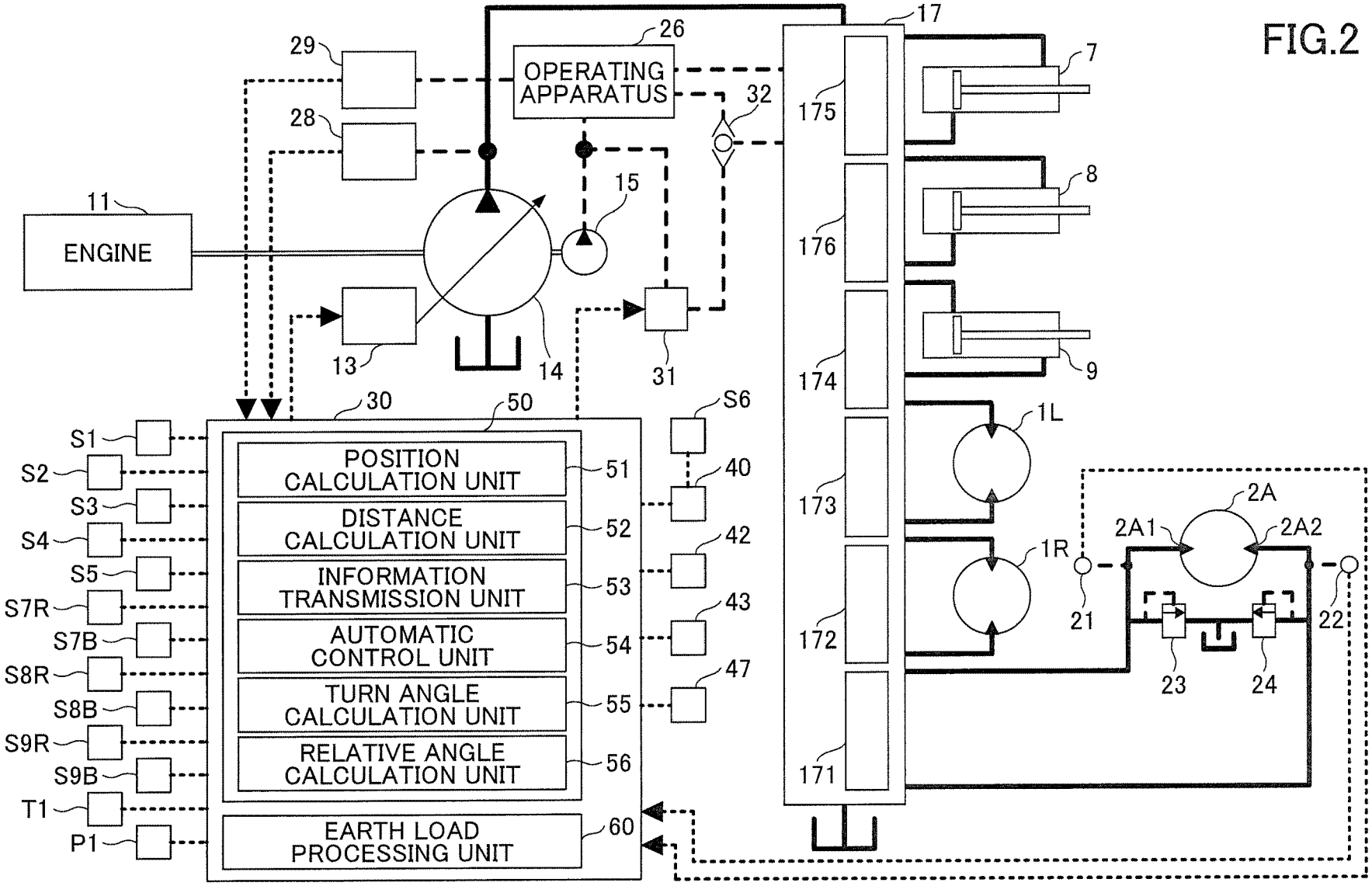
FIG. 2 is a drawing of an example of configuration of the shovel according to the present embodiment.

FIG. 2 is a drawing of an example of configuration of the shovel 100 according to the present embodiment.

In FIG. 2, a mechanical power line, a high-pressure hydraulic line, a pilot line, and an electric drive and control system are indicated by a double line, a thick solid line, a dashed line, and a thin solid line, respectively. This is also applicable to FIGS. 4A to 4C and FIGS. 6A and 6B to be explained later.

The drive system of the shovel 100 according to the present embodiment includes an engine 11, a regulator 13, a main pump 14, and a control valve unit 17. As described above, the hydraulic drive system of the shovel 100 according to the present embodiment includes hydraulic actuators, such as the traveling hydraulic motors 1L, 1R, the turning hydraulic motor 2A, the boom cylinder 7, the arm cylinder 8, and the bucket cylinder 9, which hydraulically drive the lower traveling body 1, the upper turning body 3, the boom 4, the arm 5, and the bucket 6, respectively.

The engine 11 is the main power source in the hydraulic drive system, and is mounted on the rear part of the upper turning body 3, for example. Specifically, under direct or indirect control by a controller 30 explained later, the engine 11 rotates constantly at a preset target rotational speed, and drives the main pump 14 and a pilot pump 15. The engine 11 is, for example, a diesel engine using light oil as fuel.

The regulator 13 controls the amount of discharge of the main pump 14. For example, the regulator 13 adjusts the angle (tilt angle) of a swashplate of the main pump 14 in accordance with a control instruction given by the controller 30. For example, as explained above, the regulator 13 includes regulators 13L, 13R.

The main pump 14 is mounted, for example, on the rear part of the upper turning body 3, like the engine 11, and supplies hydraulic oil to the control valve unit 17 through a high-pressure hydraulic line 16. The main pump 14 is driven by the engine 11 as described above. The main pump 14 may be, for example, a variable displacement hydraulic pump, in which the regulator 13 controls the tilt angle of the swashplate to adjust the stroke length of a piston under the control performed by the controller 30 as described above, so that the discharge flowrate (discharge pressure) can be controlled. For example, the main pump 14 includes main pumps 14L, 14R.

The control valve unit 17 is a hydraulic control device that is installed, for example, at the center of the upper turning body 3, and that controls the hydraulic drive system in accordance with an operator's operation of an operating apparatus 26. The control valve unit 17 is connected to the main pump 14 via the high-pressure hydraulic line 16 as described above, and hydraulic oil supplied from the main pump 14 is selectively supplied to the hydraulic actuators (i.e., the traveling hydraulic motors 1L, 1R, the turning hydraulic motor 2A, the boom cylinder 7, the arm cylinder 8, and the bucket cylinder 9) according to the operating state of the operating apparatus 26. Specifically, the control valve unit 17 includes control valves 171 to 176 that control the flowrates and the flow directions of hydraulic oil supplied from the main pump 14 to the respective hydraulic actuators. Specifically, the control valve unit 171 corresponds to the traveling hydraulic motor 1L, the control valve unit 172 corresponds to the traveling hydraulic motor 1R, and the control valve unit 173 corresponds to turning hydraulic motor 2A. The control valve unit 174 corresponds to bucket cylinder 9, the control valve unit 175 corresponds to boom cylinder 7, and the control valve unit 176 corresponds to arm cylinder 8. Also, for example, as explained later, the control valve unit 175 includes control valves 175L, 175R, and for example, as explained later, the control valve unit 176 includes control valves 176L, 176R. The details of the control valves 171 to 176 are explained later.

The operation system of the shovel 100 according to the present embodiment includes the pilot pump 15 and an operating apparatus 26. In addition, the operation system of the shovel 100 includes a shuttle valve 32. The shuttle valve 32 is an element for the machine control function performed by the controller 30 explained later.

The pilot pump 15 is installed, for example, on the rear part of the upper turning body 3, and applies a pilot pressure to the operating apparatus 26 via a pilot line 25. For example, the pilot pump 15 is a fixed displacement hydraulic pump, and is driven by the engine 11.

The operating apparatus 26 is provided near the operator's seat of the cab 10, and is operation input means allowing the operator to operate the operational elements (such as the lower traveling body 1, the upper turning body 3, the boom 4, the arm 5, the bucket 6, and the like). In other words, the operating apparatus 26 is operation input means for operating the hydraulic actuators (such as the traveling hydraulic motors 1L, 1R, the turning hydraulic motor 2A, the boom cylinder 7, the arm cylinder 8, and the bucket cylinder). The operating apparatus 26 is connected to the control valve unit 17 directly via a secondary-side pilot line or indirectly via a shuttle valve 32 explained later provided in a secondary-side pilot line. The control valve unit 17 receives a pilot pressure corresponding to the state of operation of the operating apparatus 26 for each of the lower traveling body 1, the upper turning body 3, the boom 4, the arm 5, the bucket 6, and the like. Accordingly, the control valve unit 17 can drive each of the hydraulic actuators in accordance with the state of operation of the operating apparatus 26. For example, the operating apparatus 26 includes a lever device for operating the arm 5 (i.e., the arm cylinder 8). For example, the operating apparatus 26 includes lever devices 26A to 26C operating the boom 4 (the boom cylinder 7), the bucket 6 (the bucket cylinder 9), and the upper turning body 3 (the turning hydraulic motor 2A), respectively (see FIG. 4). Also, for example, the operating apparatus 26 includes lever devices and pedal devices for operating the pair of right and left crawlers (traveling hydraulic motors 1L, 1R) of the lower traveling body 1.

The shuttle valve 32 includes two inlet ports and one output port, and is configured to output, from the output port, hydraulic oil having a higher pilot pressure from among the pilot pressures applied to the two inlet ports. One of the two inlet ports of the shuttle valve 32 is connected to the operating apparatus 26, and the other inlet port of the shuttle valve 32 is connected to the proportional valve 31. The output port of the shuttle valve 32 is connected to the pilot port of the corresponding control valve in the control valve unit 17 through the pilot line (for the details, see FIG. 4). Therefore, the shuttle valve 32 can apply one of the pilot pressure generated by the operating apparatus 26 and the pilot pressure generated by the proportional valve 31, whichever is higher, to the pilot port of the corresponding control valve. In other words, the controller 30 explained later outputs, from the proportional valve 31, a pilot pressure higher than the secondary-side pilot pressure output from the operating apparatus 26 to control the corresponding control valve regardless of the operation of the operating apparatus 26 by the operator. Therefore, the controller 30 can control the operation of various kinds of operation elements. For example, as explained later, the shuttle valve 32 includes shuttle valves 32AL, 32AR, 32BL, 32BR, 32CL, 32CR.

It should be noted that the operating apparatus 26 (including a left operation lever, a right operation lever, a left travelling lever, and a right travelling lever) may be an electric type outputting an electric signal, instead of a hydraulic pilot type outputting a pilot pressure. In this case, an electric signal from the operating apparatus 26 is input to the controller 30, and the controller 30 controls the control valves 171 to 176 in the control valve unit 17 in accordance with received electric signals to operate various kinds of hydraulic actuators in accordance with operation content of the operating apparatus 26. For example, the control valves 171 to 176 in the control valve unit 17 may be electromagnetic solenoid type spool valves driven in response to instructions given by the controller 30. For example, between the pilot pump 15 and the pilot ports of the control valves 171 to 176, electromagnetic valves operating in response to electric signals given by the controller 30 may be provided. In this case, when manual operation is performed with an electric operating apparatus 26, the controller 30 controls the electromagnetic valve to increase or decrease the pilot pressure in accordance with an electric signal corresponding to the amount of operation (for example, the amount of operation of the lever), so that the controller 30 can operate the control valves 171 to 176 according to the operation content of the operating apparatus 26.

The control system of the shovel 100 according to the present embodiment includes a controller 30, a discharge pressure sensor 28, an operation pressure sensor 29, a proportional valve 31, a display device 40, an input device 42, an audio output device 43, a storage device 47, a boom angle sensor S1, an arm angle sensor S2, a bucket angle sensor S3, a body inclination sensor S4, a turning state sensor S5, an image-capturing device S6, a positioning device P1, and a communication device T1.

For example, the controller 30 (an example of a control device) is provided in the cab 10 to drive and control the shovel 100. The functions of the controller 30 may be achieved by any hardware or a combination of hardware and software. For example, the controller 30 is constituted by a microcomputer including a CPU (Central Processing Unit), ROM (Read Only Memory), RAM (Random Access Memory), a non-volatile auxiliary storage device, an I/O (Input-Output) interface, and the like. The controller 30 achieves various functions by causing the CPU to execute various programs stored in the ROM and the non-volatile auxiliary storage device.

For example, the controller 30 may drive and control the engine 11 to maintain a constant rotational speed by setting a target rotation speed on the basis of a work mode and the like, which are set in advance by an operator's operation and the like.

As necessary, the controller 30 may output a control instruction to the regulator 13 to change the amount of discharge of the main pump 14.

The controller 30 may control a machine guidance function to guide the operator with respect to manual operation of the operating apparatus 26 for controlling the shovel 100. For example, the controller 30 may control a machine control function to automatically support the operator with respect to manual operation of the operating apparatus 26 for controlling of the shovel 100. In other words, the controller 30 may include a machine guidance unit 50 for the machine guidance function and the machine control function. In addition, the controller 30 includes an earth load processing unit 60 explained later.

Some of the functions of the controller 30 may be achieved by other controllers (control devices). In other words, the function of the controller 30 may be achieved as being distributed across multiple controllers. For example, the machine guidance function and the machine control function may be implemented by a dedicated controller (control device).

The discharge pressure sensor 28 detects the discharge pressure of the main pump 14. A detection signal corresponding to the discharge pressure detected by the discharge pressure sensor 28 is input to the controller 30. For example, as explained later, the discharge pressure sensor 28 includes discharge pressure sensors 28L, 28R.

As described above, the operation pressure sensor 29 detects the secondary-side pilot pressure of the operating apparatus 26, i.e., the pilot pressure corresponding to the operation state (for example, the operation content such as the operation direction, the amount of operation, and the like) of operating apparatus 26 for each operation element (i.e., the hydraulic actuators). The detection signal of the pilot pressure corresponding to the operation state of the operating apparatus 26 detected by the operation pressure sensor 29 with respect to the lower traveling body 1, the upper turning body 3, the boom 4, the arm 5, the bucket 6, and the like is input to the controller 30. For example, as explained later, the operation pressure sensor 29 includes operation pressure sensors 29A to 29C.

Instead of the operation pressure sensor 29, other sensors capable of detecting the operation state of each operation element in the operating apparatus 26 may be provided. For example, an encoder, a potentiometer, and the like capable of detecting the amount of operation (i.e., tilt amount) and the tilt direction such as lever devices 26A to 26C and the like may be provided.

The proportional valve 31 is provided in a pilot line connecting the pilot pump 15 and the shuttle valve 32, and configured to be able to change the size of area of flow (i.e., the size of a cross-sectional area in which hydraulic oil can flow). The proportional valve 31 operates in accordance with a control instruction received from the controller 30. Accordingly, even in a case where an operator is not operating the operating apparatus 26 (specifically, the lever device 26A to 26C), the controller 30 can provide hydraulic oil discharged from the pilot pump 15 via the proportional valve 31 and the shuttle valve 32 to a pilot port in a corresponding control valve in the control valve unit 17. For example, as explained later, the proportional valve 31 includes proportional valves 31AL, 31AR, 31BL, 31BR, 31CL, 31CR.

The display device 40 is provided at a position that can be easily seen by the operator who is seated in the cab 10, and the display device 40 displays various kinds of information images under the control of the controller 30. The display device 40 may be connected to the controller 30 via onboard communication network such as CAN (Controller Area Network) and the like, and may be connected to the controller 30 via a private telecommunications circuit for connection between two locations.

The input device 42 is provided in an area that can be reached by the operator who is seated in the cab 10, and the operator receives various kinds of operation inputs, and outputs a signal according to an operation input to the controller 30. The input device 42 includes, for example: a touch panel implemented on a display of a display device for displaying various kinds of information images; knob switches provided at the ends of the levers of the lever devices 26A to 26C; and button switches, levers, toggle switches, rotation dials, and the like provided around the display device 40. Signals corresponding to operation contents of the input device 42 are input to the controller 30.

For example, the audio output device 43 is provided in the cab 10 and connected to the controller 30. The audio output device 43 outputs sound under the control of the controller 30. For example, the audio output device 43 may be a speaker, a buzzer, and the like. The audio output device 43 outputs various kinds of information in response to an audio output instruction from the controller 30.

For example, the storage device 47 is provided in the cab 10, and stores various kinds of information under the control of the controller 30. For example, the storage device 47 includes a non-volatile storage medium such as semiconductor memory. The storage device 47 may store information received from various kinds of device while the shovel 100 operates, and may store information that is obtained by various kinds of device before the shovel 100 starts to operate. For example, the storage device 47 may store data of the excavation target surface obtained by a communication device T1 and the like or set with the input device 42 and the like. The excavation target surface may be set (saved) by the operator of the shovel 100, or may be set by construction managers and the like.

The boom angle sensor S1 is attached to the boom 4 to detect the elevation angle of the boom 4 with respect to the upper turning body 3 (hereinafter referred to as "boom angle"). For example, the boom angle sensor S1 detects the angle formed by a straight line connecting both ends of the boom 4 with respect to the turning plane of the upper turning body 3 in a side view. The boom angle sensor S1 may include, for example, a rotary encoder, an acceleration sensor, a six-axis sensor, an IMU (Inertial Measurement Unit), and the like. The boom angle sensor S1 may include a potentiometer constituted by a variable resistor, a cylinder sensor for detecting the amount of stroke of the hydraulic cylinder (of the boom cylinder 7) corresponding to the boom angle, and the like. The arm angle sensor S2 and the bucket angle sensor S3 are similarly configured as described above. The detection signal corresponding to the boom angle detected by the boom angle sensor S1 is input to the controller 30.

The arm angle sensor S2 is attached to the aim 5 to detect a rotation angle of the aim 5 with respect to the boom 4 (hereinafter referred to as "arm angle"). For example, the arm angle sensor S2 detects an angle formed by a straight line connecting both of the rotational axes points at both ends of the arm 5 with respect to a straight line connecting both of the rotational axes points at both ends of the boom 4 in a side view. The detection signal corresponding to the arm angle detected by the arm angle sensor S2 is input to the controller 30.

The bucket angle sensor S3 is attached to the bucket 6 to detect a rotation angle of the bucket 6 with respect to the arm 5 (hereinafter referred to as "bucket angle"). For example, the bucket angle sensor S3 detects an angle formed by a straight line connecting both of the rotational axes points at both ends of the bucket 6 with respect to a straight line connecting both of the rotational axes points at both ends of the arm 5 in a side view. The detection signal corresponding to the bucket angle detected by the bucket angle sensor S3 is input to the controller 30.

The body inclination sensor S4 detects the inclination state of the body (the upper turning body 3 or the lower traveling body 1) with respect to the horizontal plane. For example, the body inclination sensor S4 is attached to the upper turning body 3 to detect inclination angles about two axes, i.e., an inclination angle in the longitudinal direction and an inclination angle in a lateral direction of the shovel 100 (i.e., the upper turning body 3), which are hereinafter referred to as a "longitudinal inclination angle" and a "lateral inclination angle", respectively. The body inclination sensor S4 may include, for example, a rotary encoder, an acceleration sensor, a six-axis sensor, an IMU, and the like. Detection signals corresponding to inclination angles (i.e., the longitudinal inclination angle and the lateral inclination angle) detected by the body inclination sensor S4 are input to the controller 30.

The turning state sensor S5 outputs detection information about the turning state of the upper turning body 3. For example, the turning state sensor S5 detects a turning angular speed and a turning angle of the upper turning body 3. For example, the turning state sensor S5 may include a gyro sensor, a resolver, a rotary encoder, and the like. Detection signals corresponding to the turning angular speed and the turning angle of the upper turning body 3 detected by the turning state sensor S5 are input to the controller 30.

The image-capturing device S6 serving as a spatial recognition device captures images around the shovel 100. The image-capturing device S6 includes a camera S6F configured to capture images in front of the shovel 100, a camera S6L configured to capture images at the left-hand side of the shovel 100, a camera S6R configured to capture images at the right-hand side of the shovel 100, and a camera S6B configured to capture images at the rear of the shovel 100.

For example, the camera S6F is attached to the inside of the cab 10, e.g., the ceiling of the cab 10. Alternatively, the camera S6F may be attached to the outside of the cab 10, e.g., the roof of the cab 10 and the side surface of the boom 4. The camera S6L is attached to the left end on the upper surface of the upper turning body 3, the camera S6R is attached to the right end on the upper surface of the upper turning body 3, and the camera S6B is attached to the rear end on the upper surface of the upper turning body 3.

In the image-capturing device S6, for example, each of the cameras S6F, S6B, S6L, S6R is a single-lens wide-angle camera having an extremely wide field of view. Alternatively, each of the cameras S6F, S6B, S6L, S6R may include a stereo camera, a distance image sensor, and the like. Images captured by the image-capturing device S6 are input to the controller 30 via the display device 40.

The image-capturing device S6 serving as the spatial recognition device may function as an object detection device. In this case, the image-capturing device S6 may detect an object around the shovel 100. Examples of objects to be detected by the image-capturing device S6 include people, animals, vehicles, construction machines, buildings, holes, and the like. The image-capturing device S6 may be configured to calculate a distance to a detected object from the image-capturing device S6 or from the shovel 100. When the image-capturing device S6 works as a spatial recognition device, the image-capturing device S6 may include a stereo camera, a distance image sensor, and the like. For example, the spatial recognition device is a single-lens camera having image-capturing devices such as a CCD and a CMOS, and outputs the captured images to the display device 40. Also, the spatial recognition device may be configured to calculate the distance to a detected object from the spatial recognition device or from the shovel 100. In addition to the image-capturing device S6, for example, other object detection devices such as an ultrasonic sensor, a millimeter wave radar, a LIDAR device, and an infrared sensor may be provided as the spatial recognition device. When a millimeter wave radar, an ultrasonic sensor, a laser radar, or the like is used as the spatial recognition device 80, many signals (e.g., laser lights and the like) may be transmitted to the object, and the reflection signals may be received, so that the distance and the direction to the object may be detected from the reflection signals.

The image-capturing device S6 may be directly communicably connected to the controller 30.

A boom rod pressure sensor S7R and a boom bottom pressure sensor S7B are attached to the boom cylinder 7. An arm rod pressure sensor S8R and an arm bottom pressure sensor S8B are attached to the aim cylinder 8. A bucket rod pressure sensor S9R and a bucket bottom pressure sensor S9B are attached to the bucket cylinder 9. The boom rod pressure sensor S7R, the boom bottom pressure sensor S7B, the aim rod pressure sensor S8R, the arm bottom pressure sensor S8B, the bucket rod pressure sensor S9R, and the bucket bottom pressure sensor S9B are collectively referred to as "cylinder pressure sensors".

The boom rod pressure sensor S7R detects the pressure of the rod-side oil chamber of the boom cylinder 7 (hereinafter referred to as "boom rod pressure"), and the boom bottom pressure sensor S7B detects the pressure of the bottom-side oil chamber of the boom cylinder 7 (hereinafter referred to as "boom bottom pressure"). The arm rod pressure sensor S8R detects the pressure of the rod-side oil chamber of the arm cylinder 8 (hereinafter referred to as "arm rod pressure"), and the arm bottom pressure sensor S8B detects the pressure of the bottom-side oil chamber of the arm cylinder 8 (hereinafter referred to as "arm bottom pressure"). The bucket rod pressure sensor S9R detects the pressure of the rod-side oil chamber of the bucket cylinder 9 (hereinafter referred to as "bucket rod pressure"), and the bucket bottom pressure sensor S9B detects the pressure of the bottom-side oil chamber of the bucket cylinder 9 (hereinafter referred to as "bucket bottom pressure").

The positioning device P1 is configured to measure the position and the orientation of the upper turning body 3. The positioning device P1 may be, for example, a GNSS compass, and detects the position and orientation of the upper turning body 3 to output detected values of the position and orientation of the upper turning body 3 to the controller 30. Of the functions of the positioning device P1, a function for detecting the orientation of the upper turning body 3 may be replaced with an azimuth sensor attached to the upper turning body 3.

The communication device T1 communicates with an external device through a predetermined or given network including a mobile communication network that includes a base station as a terminal, a satellite communication network, an Internet network, and the like. For example, the communication device T1 may include mobile communication modules according to mobile communication standards such as LTE (Long Term Evolution), 4G (4th Generation), 5G (5th Generation), and the like; satellite communication modules for connecting to satellite communication networks; and the like.

For example, the machine guidance unit 50 controls of the shovel 100 with respect to the machine guidance function. For example, the machine guidance unit 50 uses the display device 40 or the audio output device 43 to inform the operator of work information about a distance between the end portion of the attachment and the excavation target surface, for example, work information about, e.g., a distance of the end attachment from the work part. For example, as described above, data about the excavation target surface is stored in the storage device 47 in advance. The data of the excavation target surface is expressed by the World Geodetic System. The World Geodetic System is a three-dimensional orthogonal XYZ coordinate system in which the origin is at the center of gravity of the earth, the X-axis passes through the intersection of the Greenwich meridian and the equator, the Y-axis passes through 90 degrees east longitude, and the Z-axis passes through the north pole. In the present embodiment, the World Geodetic System is a three-dimensional orthogonal XYZ coordinate system with the Z axis being in the direction of the North Pole. The operator may define any given point on the construction site as a reference point, and may use the input device 42 to set an excavation target surface relative to the reference point. The work part of the bucket 6 includes teeth end of the bucket 6, the back surface of the bucket 6, and the like. In a case where a breaker is used as the end attachment instead of bucket 6, the end portion of the breaker corresponds to the work part. The machine guidance unit 50 notifies work information to the operator by the display device 40, the audio output device 43, and the like, and guides the operator in the operation of the shovel 100 with the operating apparatus 26.

For example, the machine guidance unit 50 controls the shovel 100 with respect to the machine control function. For example, while the operator is manually performing excavation operation, the machine guidance unit 50 may automatically move at least one of the boom 4, the arm 5, and the bucket 6 to cause the end position of the bucket 6 to coincide with the excavation target surface.

The machine guidance unit 50 obtains information from the boom angle sensor S1, the arm angle sensor S2, the bucket angle sensor S3, the body inclination sensor S4, the turning state sensor S5, the image-capturing device S6, the positioning device P1, the communication device T1, the input device 42, and the like. Then, for example, the machine guidance unit 50 calculates the distance between the bucket 6 and the excavation target surface on the basis of the obtained information. Accordingly, for example, the machine guidance unit 50 notifies the operator of the magnitude of the distance between the bucket 6 and the excavation target surface by causing the audio output device 43 to make sound and/or causing the display device 40 to display an image. Alternatively or in addition, for example, the machine guidance unit 50 automatically controls the operation of the attachment so that the end portion of the attachment (the work part of the bucket 6 such as teeth end of the bucket 6, the back surface of the bucket 6, and the like) coincides with the excavation target surface. The machine guidance unit 50 includes a position calculation unit 51, a distance calculation unit 52, an information transmission unit 53, an automatic control unit 54, a turning angle calculation unit 55, and a relative angle calculation unit 56, as detailed functional configuration of the machine guidance function and the machine control function.

The position calculation unit 51 calculates the position of a predetermined or given positioning target. For example, the position calculation unit 51 calculates the coordinate point of the end portion of the attachment. For example, the position calculation unit 51 calculates the coordinate point of the work part of the bucket 6 such as teeth end of the bucket 6, the back surface of the bucket 6, and the like in the reference coordinate system. Specifically, the position calculation unit 51 calculates the coordinate point of the work part of the bucket 6 from the elevation angles of the boom 4, the arm 5, and the bucket 6 (i.e., the boom angle, the arm angle, and the bucket angle).

The distance calculation unit 52 calculates a distance between the two positioning targets. For example, the distance calculation unit 52 calculates the distance between the end portion of the attachment and the excavation target surface. For example, the distance calculation unit 52 calculates the distance between the excavation target surface and the work part of the bucket 6 such as teeth end of the bucket 6, the back surface of the bucket 6, and the like. Also, the distance calculation unit 52 may calculate an angle (a relative angle) between the excavation target surface and the back surface of the bucket 6, i.e., the work part of the bucket 6.

The information transmission unit 53 transmits (notifies) various kinds of information to the operator of the shovel 100 by predetermined or given notification means such as the display device 40 and the audio output device 43. The information transmission unit 53 notifies the operator of the shovel 100 of the magnitude (degree) of various kinds of distance calculated by the distance calculation unit 52. For example, the information transmission unit 53 uses at least one of visual information displayed on the display device 40 and auditory information made by the audio output device 43 to inform the operator of (the magnitude of) the distance between the end portion of the bucket 6 and the excavation target surface. The information transmission unit 53 may use at least one of visual information displayed on the display device 40 and auditory information made by the audio output device 43 to inform the operator of (the magnitude of) the relative angle between the excavation target surface and the back surface of the bucket 6, i.e., the work part of the bucket 6.

Specifically, the information transmission unit 53 uses intermittent sound made by the audio output device 43 to inform the operator of the magnitude of the distance (for example, a perpendicular distance) between the work part of the bucket 6 and the excavation target surface. In this case, as the perpendicular distance decreases, the information transmission unit 53 may decrease the interval of intermittent sound, and as the perpendicular distance increases, the information transmission unit 53 may increase the interval of intermittent sound. Also, the information transmission unit 53 may use continuous sound and may express difference in the magnitude of the perpendicular distance by changing the tone of sound, the intensity of sound, and the like. In a case where the end portion of the bucket 6 comes to a position lower than the excavation target surface, i.e., the end portion of the bucket 6 is beyond the excavation target surface, the information transmission unit 53 may give warning with the audio output device 43. For example, the warning is a continuous sound significantly larger than the intermittent sound.

The information transmission unit 53 may cause the display device 40 to display the magnitude of the distance between the end portion of the attachment, for example, the work part of the bucket 6, and the excavation target surface, the magnitude of the relative angle between the back surface of the bucket 6 and the excavation target surface, and the like. For example, under the control of the controller 30, the display device 40 displays image data received from the image-capturing device S6 and the work information received from the information transmission unit 53. For example, the information transmission unit 53 may use an image of an analog meter, an image of a bar graph indicator, and the like to inform the operator of the magnitude of the perpendicular distance.

The automatic control unit 54 automatically supports operator's manual operation of the shovel 100 with the operating apparatus 26 by automatically moving the actuators. Specifically, as explained later, the automatic control unit 54 can automatically adjust the respective pilot pressures applied to the corresponding control valves (i.e., the control valve unit 173, the control valves 175L, 175R, and the control valve unit 174) corresponding to the hydraulic actuators (i.e., the turning hydraulic motor 2A, the boom cylinder 7, and the bucket cylinder 9). Accordingly, the automatic control unit 54 can automatically operate the respective hydraulic actuators. For example, the control of the machine control function by the automatic control unit 54 may be executed when a predetermined or given switch included in the input device 42 is pressed down. For example, the predetermined or given switch is a machine control switch (hereinafter referred to as "MC (Machine Control) switch"), which may be provided as a knob switch at an end of a grip portion of the operating apparatus 26 (for example, a lever device corresponding to operation of the arm 5) gripped by the operator. Hereinafter, it is assumed that the machine control function is enabled when the MC switch is pressed down.

For example, in a case where the MC switch and the like is pressed down, the automatic control unit 54 automatically extends or retracts at least one of the boom cylinder 7 and the bucket cylinder 9 in accordance with the operation of the arm cylinder 8 in order to support the excavation work and levelling work. Specifically, in a case where the operator is manually performing closing operation (hereinafter referred to as "arm closing operation") to close the arm 5, the automatic control unit 54 automatically extends or retracts at least one of the boom cylinder 7 and the bucket cylinder 9 so that the position of the work part of the bucket 6 such as teeth end of the bucket 6, the back surface of the bucket 6, and the like coincides with the position of the excavation target surface. In this case, for example, the operator can close the arm 5 so as to cause the teeth end of the bucket 6 and the like to coincide with the excavation target surface by just performing arm closing operation with the lever device corresponding to the operation of the arm 5.

In a case where an MC switch and the like is pressed down, the automatic control unit 54 may automatically rotate the turning hydraulic motor 2A (an example of an actuator) so as to make the upper turning body 3 face the excavation target surface. Hereinafter, the control performed by the controller 30 (specifically, the automatic control unit 54) to cause the upper turning body 3 to face the excavation target surface is referred to as "facing control". Therefore, the operator and the like can cause the upper turning body 3 to face the excavation target surface by just pressing a predetermined or given switch or operating the lever device 26C explained later corresponding to the turning operation while the predetermined or given switch is held down. Also, the operator can cause the upper turning body 3 to face the excavation target surface and start the machine control function of the excavation work and the like of the excavation target surface explained above by just pressing down the MC switch.

For example, the state in which the upper turning body 3 of the shovel 100 faces the excavation target surface is a state in which the end portion of the attachment (for example, the teeth end, the back surface, and the like, serving as the work part of the bucket 6) can be moved along the inclination direction of the excavation target surface (i.e., the finished ascending slope BS) in accordance with the operation of the attachment. Specifically, the state in which the upper turning body 3 of the shovel 100 faces the excavation target surface is a state in which an operation plane (attachment operation plane) of the attachment perpendicular to the turning plane of the shovel 100 includes a line, corresponding to the cylindrical body, normal to the excavation target surface (in other words, a state in which the attachment operation plane includes the line normal to the excavation target surface).

In a case where the shovel 100 is not in the state in which the attachment operation plane of the shovel 100 includes the line, corresponding to the cylindrical body, normal to the excavation target surface, the end portion of the attachment cannot move along the excavation target surface in the inclination direction. Therefore, as a result, the shovel 100 cannot appropriately construct the excavation target surface. Therefore, the automatic control unit 54 automatically rotates the turning hydraulic motor 2A to cause the upper turning body 3 to face the excavation target surface. Accordingly, the shovel 100 can appropriately construct the excavation target surface.

In a case where, in the facing control, for example, a left end perpendicular distance between a coordinate point at the left end of the teeth end of the bucket 6 and the excavation target surface (hereinafter referred to as "left end perpendicular distance") becomes equal to a right end perpendicular distance between a coordinate point at the right end of the teeth end of the bucket 6 and the excavation target surface (hereinafter simply referred to as "right end perpendicular distance"), the automatic control unit 54 determines that the shovel faces the excavation target surface. The automatic control unit 54 may determine that the shovel 100 faces the excavation target surface in a case where, instead of the left end perpendicular distance being equal to the right end perpendicular distance (i.e., a difference between the left end perpendicular distance and the right end perpendicular distance is zero) as described above, the difference is equal to or less than a predetermined or given value.

Also, in the facing control, for example, the automatic control unit 54 may move the turning hydraulic motor 2A on the basis of a difference between the left end perpendicular distance and the right end perpendicular distance. Specifically, when the lever device 26C corresponding to the turning operation is operated while a predetermined or given switch such as the MC switch is pressed down, the automatic control unit 54 determines whether the lever device 26C is operated in a direction to cause the upper turning body 3 to face the excavation target surface. For example, in a case where the lever device 26C is operated in a direction to increase the perpendicular distance between the teeth end of the bucket 6 and the excavation target surface (i.e., the finished ascending slope BS), the automatic control unit 54 does not execute the facing control. On the contrary, in a case where the lever device 26C is operated in a direction to decrease the perpendicular distance between the teeth end of the bucket 6 and the excavation target surface (i.e., the finished ascending slope BS), the automatic control unit 54 executes the facing control. As a result, the automatic control unit 54 can move the turning hydraulic motor 2A to decrease the difference between the left end perpendicular distance and the right end perpendicular distance. Thereafter, when the difference becomes equal to or less than the predetermined or given value or becomes zero, the automatic control unit 54 stops the turning hydraulic motor 2A. The automatic control unit 54 may set, as a target angle, a turning angle at which the difference becomes equal to or less than the predetermined or given value or becomes zero, and perform operation control of the turning hydraulic motor 2A so as to make the angle difference between the target angle and the current turning angle (specifically, a detected value based on the detection signal given by the turning state sensor S5) be zero. In this case, the turning angle is, for example, an angle of the longitudinal axis of the upper turning body 3 with respect to the reference direction.

As described above, in a case where, instead of the turning hydraulic motor 2A, a turning motor is mounted on the shovel 100, the automatic control unit 54 performs facing control with the turning motor (an example of an actuator) being a control target.

The turning angle calculation unit 55 calculates the turning angle of the upper turning body 3. Accordingly, the controller 30 can identify the current orientation of the upper turning body 3. For example, the turning angle calculation unit 55 calculates, as the turning angle, the angle of the longitudinal axis of the upper turning body 3 with respect to the reference direction, on the basis of an output signal of a GNSS compass included in the positioning device P1. Also, the turning angle calculation unit 55 calculates the turning angle on the basis of the detection signal of the turning state sensor S5. In a case where a reference point is set in the construction site, the turning angle calculation unit 55 may define, as a reference direction, the direction of the reference point as seen from the turning axis.

The turning angle indicates the direction in which the attachment operation plane extends with respect to the reference direction. For example, the attachment operation plane is a virtual plane that crosses the attachment and that is arranged to be perpendicular to the turning plane. For example, the turning plane is a virtual plane that includes a bottom surface of a turning frame perpendicular to the turning axis. For example, in a case where the attachment operation plane includes a normal to the excavation target surface, the controller 30 (the machine guidance unit 50) determines that the upper turning body 3 faces the excavation target surface.

The relative angle calculation unit 56 calculates a turning angle (i.e., a relative angle) used to cause the upper turning body 3 to face the excavation target surface. For example, the relative angle is a relative angle formed between a direction of the longitudinal axis of the upper turning body 3 with the upper turning body 3 facing the excavation target surface and the current direction of the longitudinal axis of the upper turning body 3. For example, the relative angle calculation unit 56 calculates the relative angle on the basis of data about the excavation target surface stored in the storage device 47 and the turning angle calculated by the turning angle calculation unit 55.

When the lever device 26C corresponding to the turning operation is operated while a predetermined or given switch such as the MC switch is pressed down, the automatic control unit 54 determines whether turning operation is performed in a direction to cause the upper turning body 3 to face the excavation target surface. In a case where the turning operation is performed in the direction to cause the upper turning body 3 to face the excavation target surface, the automatic control unit 54 sets, as the target angle, the relative angle calculated by the relative angle calculation unit 56. Then, in a case where a change of the turning angle attains a target angle after the lever device 26C is operated, the automatic control unit 54 determines that the upper turning body 3 may face the excavation target surface, and may stop the operation of the turning hydraulic motor 2A. Therefore, on the basis of the configuration as illustrated in FIG. 2, the automatic control unit 54 can cause the upper turning body 3 to face the excavation target surface. In the above embodiment of the facing control, an example of the facing control with respect to the excavation target surface has been described. However, the present disclosure is not limited thereto. For example, even in a scooping operation for loading temporarily placed earth to a dump truck, a target excavation track corresponding to a target volume may be generated, and a facing control of the turning operation may be performed to cause the attachment to face the target excavation track. In this case, on every scooping operation, the target excavation track is changed. Therefore, after the earth is unloaded to the dump truck, facing control is performed with respect to a newly changed target excavation track.

In addition, the turning hydraulic motor 2A includes a first port 2A1 and a second port 2A2. The hydraulic sensor 21 detects pressure force of hydraulic oil of the first port 2A1 of the turning hydraulic motor 2A. The hydraulic sensor 22 detects the pressure force of the hydraulic oil at the second port 2A2 of the turning hydraulic motor 2A. Detection signals corresponding to the discharge pressures detected by the hydraulic sensors 21, 22 are input to the controller 30.

Also, the first port 2A1 is connected via the relief valve 23 to a hydraulic oil tank. When the pressure force at the first port 2A1 attains a predetermined or given relief pressure, the relief valve 23 opens to discharge the hydraulic oil at the first port 2A1 to the hydraulic oil tank. Likewise, the second port 2A2 is connected via the relief valve 24 to the hydraulic oil tank. When the pressure force at the second port 2A2 attains a predetermined or given relief pressure, the relief valve 24 opens to discharge the hydraulic oil at the second port 2A2 to the hydraulic oil tank.

[Hydraulic System of Shovel]

Next, the hydraulic system of the shovel 100 according to the present embodiment is explained with reference to FIG. 3.

Figure 3:
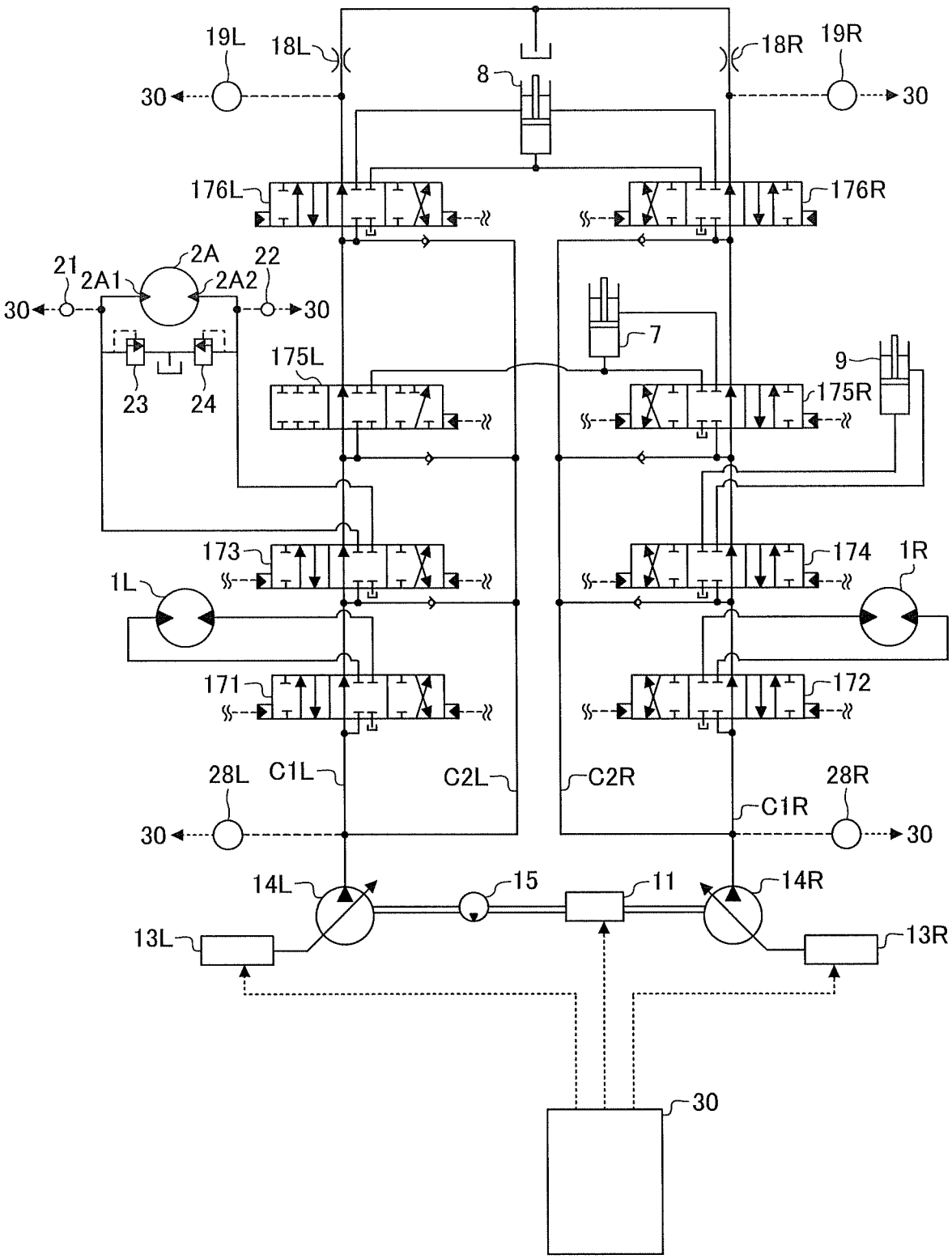
FIG. 3 is a drawing of an example of configuration of a hydraulic system of the shovel according to the present embodiment.

FIG. 3 is a drawing of an example of configuration of the hydraulic system of the shovel 100 according to the present embodiment.

In FIG. 3, like FIG. 2, a mechanical power line, a high-pressure hydraulic line, a pilot line, and an electric drive and control system are indicated by a double line, a thick solid line, a dashed line, and a thin solid line, respectively.

In the hydraulic system achieved by the hydraulic circuit, the main pumps 14L, 14R driven by the engine 11 circulate hydraulic oil into the hydraulic oil tank through center bypass pipelines C1L, C1R and parallel pipelines C2L, C2R.

The center bypass pipeline C1L starts from the main pump 14L, passes through, in order, the control valves 171, 173, 175L, 176L provided within the control valve unit 17, and reaches the hydraulic oil tank.

The center bypass pipeline C1R starts from the main pump 14R, passes through, in order, the control valves 172, 174, 175R, 176R provided within the control valve unit 17, and reaches the hydraulic oil tank.

The control valve unit 171 is a spool valve that supplies the hydraulic oil discharged from the main pump 14L to the traveling hydraulic motor 1L, and that discharges the hydraulic oil discharged from the traveling hydraulic motor 1L to the hydraulic oil tank.

The control valve unit 172 is a spool valve that supplies the hydraulic oil discharged from the main pump 14R to the traveling hydraulic motor 1R and discharges the hydraulic oil discharged from the traveling hydraulic motor 1R to the hydraulic oil tank.

The control valve unit 173 is a spool valve that supplies the hydraulic oil discharged from the main pump 14L to the turning hydraulic motor 2A and discharges the hydraulic oil discharged from the turning hydraulic motor 2A to the hydraulic oil tank.

The control valve unit 174 is a spool valve that supplies the hydraulic oil discharged from the main pump 14R to the bucket cylinder 9 and discharges the hydraulic oil from the bucket cylinder 9 to the hydraulic oil tank.

The control valves 175L, 175R are spool valves that supply the hydraulic oil discharged from the main pumps 14L, 14R to the boom cylinder 7 and discharge the hydraulic oil from the boom cylinder 7 to the hydraulic oil tank.

The control valves 176L, 176R supply the hydraulic oil discharged from the main pumps 14L, 14R to the arm cylinder 8, and discharge the hydraulic oil from the arm cylinder 8 to the hydraulic oil tank.

The control valves 171, 172, 173, 174, 175L, 175R, 176L, and 176R adjust the flow rates of the hydraulic oils supplied to and discharged from the hydraulic actuators and switch the flowing directions according to the pilot pressures acting on the pilot ports.

The parallel pipeline C2L supplies the hydraulic oil of the main pump 14L to the control valves 171, 173, 175L 176L in parallel with the center bypass pipeline C1L. Specifically, the parallel pipeline C2L branches from the center bypass pipeline C1L at the upstream side of the control valve unit 171, and is configured to supply the hydraulic oil of the main pump 14L to each of the control valves 171, 173, 175L, 176R in parallel. Accordingly, in a case where any one of the control valves 171, 173, 175L limits or cut off the flow of the hydraulic oil passing through the center bypass pipeline C1L, the parallel pipeline C2L can supply the hydraulic oil to a control valve further downstream.

The parallel pipeline C2R supplies the hydraulic oil of the main pump 14R to the control valves 172, 174, 175R, 176R in parallel with the center bypass pipeline C1R. Specifically, the parallel pipeline C2R branches from the center bypass pipeline C1R at the upstream side of the control valve unit 172, and is configured to supply the hydraulic oil of the main pump 14R in parallel with each of the control valves 172, 174, 175R, 176R in parallel. Accordingly, in a case where any one of the control valves 172, 174, 175R limits or cut off the flow of the hydraulic oil passing through the center bypass pipeline C1R, the parallel pipeline C2R can supply the hydraulic oil to a control valve further downstream.

The regulators 13L and 13R adjust the amounts of discharge of the main pumps 14L, 14R by adjusting the tilt angles of the swashplates of the main pumps 14L, 14R, respectively, under the control of the controller 30.

The discharge pressure sensor 28L detects the discharge pressure of the main pump 14L. A detection signal corresponding to the detected discharge pressure is input to the controller 30. This is also applicable to the discharge pressure sensor 28R. Accordingly, the controller 30 controls the regulators 13L, 13R according to the discharge pressures of the main pumps 14L, 14R.

The center bypass pipelines C1L, C1R include negative control throttles 18L, 18R between the most downstream control valves 176L, 176R and the hydraulic oil tank. The flow of hydraulic oil discharged from the main pumps 14L, 14R is limited by the negative control throttles 18L, 18R. The negative control throttles 18L, 18R generate a control pressure (hereinafter referred to as a "negative control pressure") so as to control the regulators 13L, 13R.

The negative control pressure sensors 19L, 19R detect negative control pressures. Detection signals corresponding to the detected negative control pressures are input to the controller 30.

The controller 30 may control the regulators 13L, 13R and adjust the amounts of discharge of the main pumps 14L, 14R according to the discharge pressures of the main pumps 14L, 14R detected by the discharge pressure sensors 28L, 28R. For example, the controller 30 may reduce the amount of discharges by controlling the regulator 13L according to the increase of the discharge pressure of the main pump 14L and adjusting the swashplate tilt angle of the main pump 14L. The same applies to regulator 13R. Accordingly, the controller 30 can perform total horse power control of the main pumps 14L, 14R so that suction horse powers of the main pumps 14L, 14R expressed by a product of the discharge pressure and the amount of discharge does not exceed the output horse power of the engine 11.

Also, the controller 30 may adjust the amounts of discharges of the main pumps 14L, 14R by controlling the regulators 13L, 13R according to the negative control pressures detected by the negative control pressure sensors 19L, 19R. For example, as the negative control pressure increases, the controller 30 decreases the amounts of discharges of the main pumps 14L, 14R, and as the negative control pressure decreases, the controller 30 increases the amounts of discharges of the main pumps 14L, 14R.

Specifically, in a case where the hydraulic actuator in the shovel 100 is in a standby state (a state as illustrated in FIG. 3) in which no operation is performed, the hydraulic oils discharged from the main pumps 14L, 14R pass through the center bypass pipelines C1L, C1R to reach the negative control throttles 18L, 18R. Then, the flows of the hydraulic oils discharged from the main pumps 14L, 14R increase the negative control pressures generated at the upstream of the negative control throttles 18L, 18R. As a result, the controller 30 decreases the amounts of discharges of main pumps 14L, 14R to the allowable minimum amounts of discharges, and reduce pressure force loss (pumping loss) that occurs when the discharged hydraulic oils pass through the center bypass pipelines C1L, C1R.

Conversely, in a case where any one of the hydraulic actuators is operated by the operating apparatus 26, the hydraulic oils discharged from the main pumps 14L, 14R flow via the corresponding control valves to the operation target hydraulic actuators. Accordingly, the amounts of the hydraulic oils discharged from the main pumps 14L, 14R and reaching the negative control throttles 18L, 18R decrease or disappear, so that the negative control pressures occurring at the upstream of the negative control throttles 18L, 18R decrease. As a result, the controller 30 increase the amounts of discharges of main pumps 14L, 14R, and circulate hydraulic oils sufficient for the hydraulic actuators of the operation targets, so that the hydraulic actuators of the operation targets can be driven reliably.

[Detailed Configuration of Machine Control Function of Shovel]

Next, the machine control function of the shovel 100 is explained in detail with reference to FIGS. 4A to 4C.

Figure 4A:
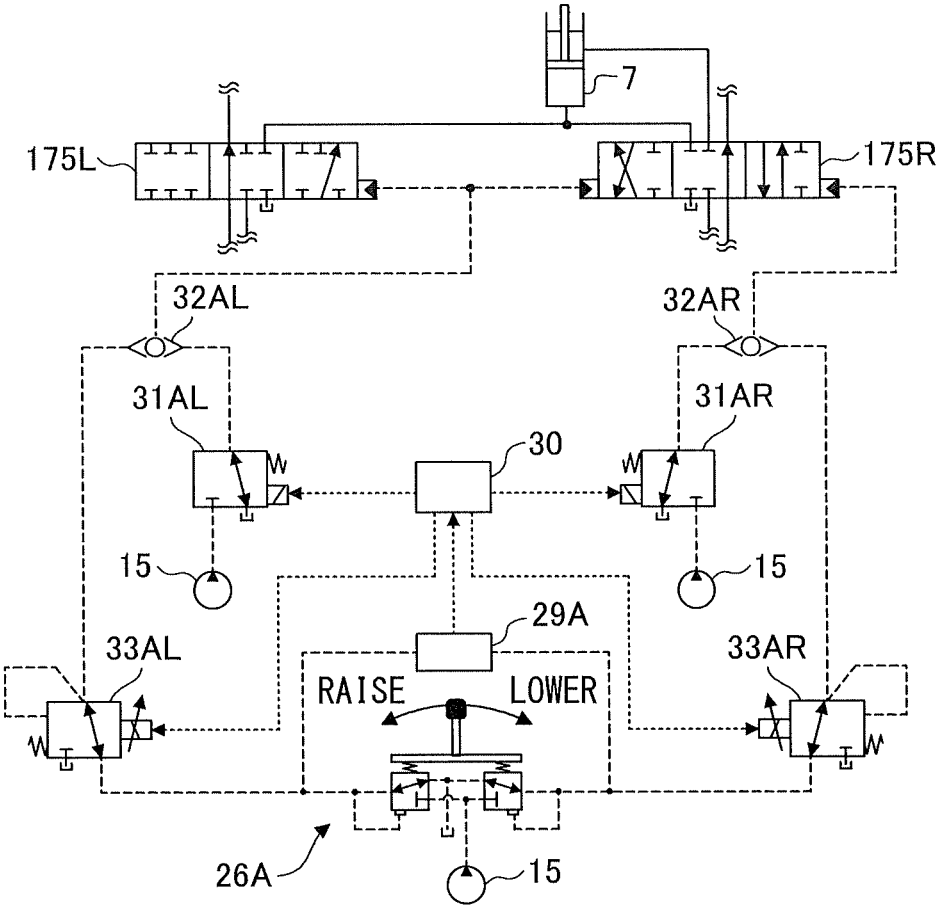
FIGS. 4A to 4C are drawings schematically illustrating an example of an operation system of a hydraulic system of the shovel according to the present embodiment.
Figure 4B:
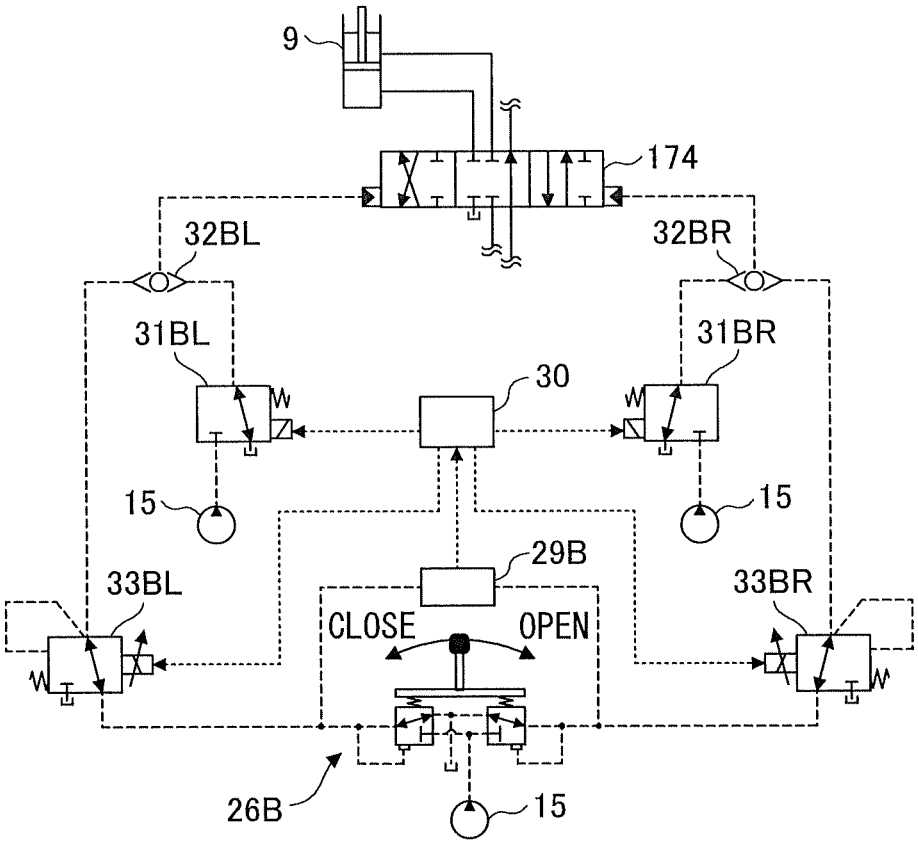
Figure 4C:
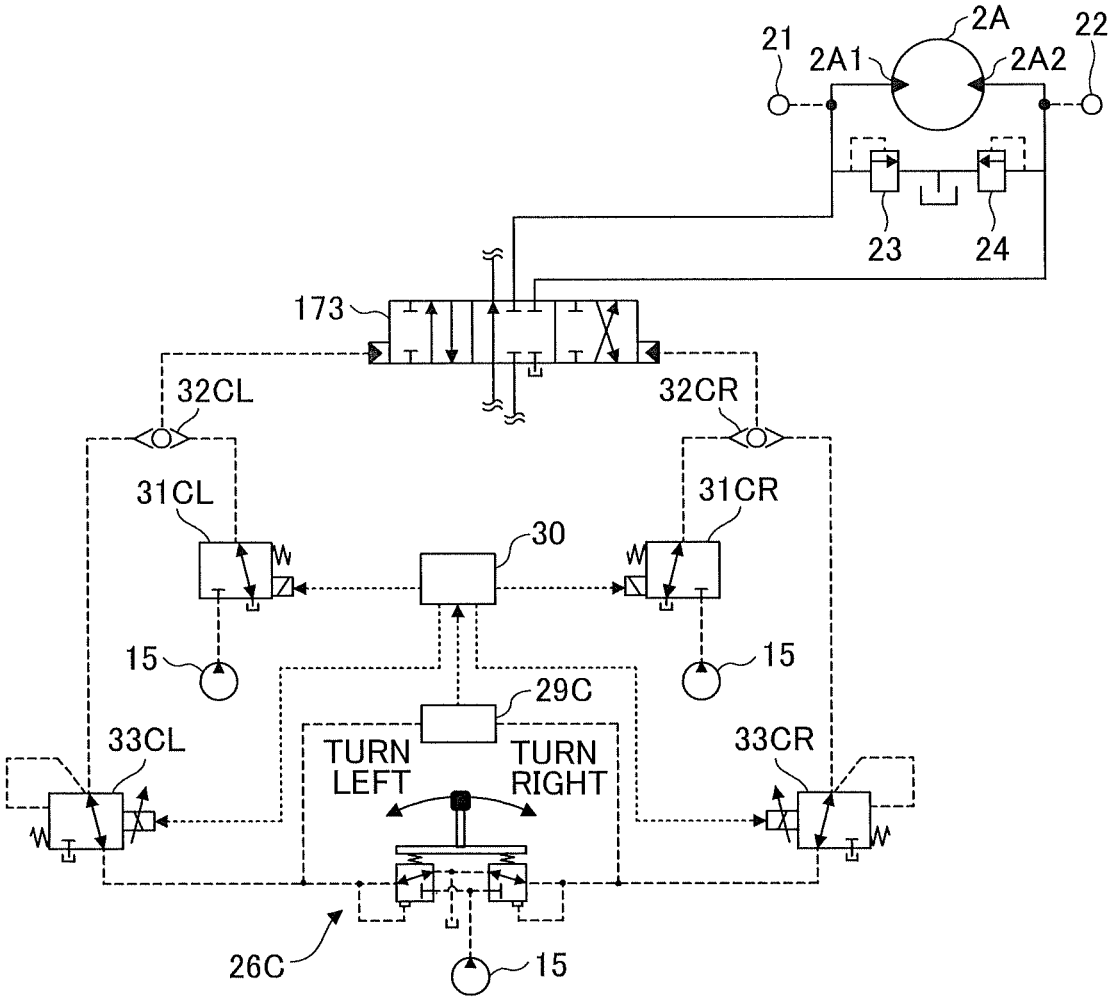

FIGS. 4A to 4C are drawings schematically illustrating an example of an operation system of the hydraulic system of the shovel 100 according to the present embodiment. Specifically, FIG. 4A is a diagram illustrating an example of a pilot circuit applying a pilot pressure to the control valves 175L, 175R hydraulically controlling the boom cylinder 7. FIG. 4B is a diagram illustrating an example of a pilot circuit applying a pilot pressure to the control valve unit 174 hydraulically controlling the bucket cylinder 9. FIG. 4C is a diagram illustrating an example of a pilot circuit applying a pilot pressure to the control valve unit 173 hydraulically controlling the turning hydraulic motor 2A.

For example, as illustrated in FIG. 4A, the lever device 26A is used by the operator and the like to operate the boom cylinder 7 corresponding to the boom 4. The lever device 26A uses the hydraulic oil discharged from the pilot pump 15 to output the pilot pressure to the secondary side according to the operation content.

The two respective inlet ports of the shuttle valve 32AL are connected to the secondary-side pilot line of the lever device 26A corresponding to an operation in a direction to raise the boom 4 (hereinafter "boom raising operation") and the secondary-side pilot line of the proportional valve 31AL. The output port of the shuttle valve 32AL is connected to the pilot port at the right side of the control valve unit 175L and the pilot port at the left side of the control valve unit 175R.

The two respective inlet ports of the shuttle valve 32AR are connected to the secondary-side pilot line of the lever device 26A corresponding to an operation in a direction to lower the boom 4 (hereinafter "boom lowering operation") and the secondary-side pilot line of the proportional valve 31AR. The output port of the shuttle valve 32AR is connected to the pilot port at the right side of the control valve unit 175R.

In other words, the lever device 26A applies, to the pilot ports of the control valves 175L, 175R, the pilot pressures according to the operation content (for example, the operation direction and the amount of operation) via the shuttle valves 32AL, 32AR. Specifically, in a case where the boom raising operation is performed with the lever device 26A, the lever device 26A outputs the pilot pressure according to the amount of operation to one of the inlet ports of the shuttle valve 32AL to apply the pilot pressure to the pilot port at the right side of the control valve unit 175L and the pilot port at the left side of the control valve unit 175R via the shuttle valve 32AL. In a case where the boom lowering operation is performed with the lever device 26A, the lever device 26A outputs the pilot pressure according to the amount of operation to one of the inlet ports of the shuttle valve 32AR to apply the pilot pressure to the pilot port at the right side of the control valve unit 175R via the shuttle valve 32AR.

The proportional valve 31AL operates according to the control current received from the controller 30. Specifically, the proportional valve 31AL uses the hydraulic oil discharged from the pilot pump 15 to output a pilot pressure according to a control current received from the controller 30 to the other of the inlet ports of the shuttle valve 32AL. Accordingly, the proportional valve 31AL can adjust the pilot pressures applied to the pilot port at the right side of the control valve unit 175L and the pilot port at the left side of the control valve unit 175R via the shuttle valve 32AL.

The proportional valve 31AR operates according to a control current received from the controller 30. Specifically, the proportional valve 31AR uses the hydraulic oil discharged from the pilot pump 15 to output a pilot pressure according to a control current received from the controller 30 to the other of the inlet ports of the shuttle valve 32AR.

Accordingly, the proportional valve 31AR can adjust the pilot pressure applied to the pilot port at the right side of the control valve unit 175R via the shuttle valve 32AR.

In other words, regardless of the operation state of the lever device 26A, the proportional valves 31AL, 31AR can adjust the pilot pressure that is output at the secondary side, so that the control valves 175L, 175R can be stopped at any given valve position.

Like the proportional valve 31AL, the proportional valve 33AL functions as a control valve for machine control. The proportional valve 33AL is arranged in a conduit connecting the operating apparatus 26 and the shuttle valve 32AL and configured to be able to change the flow passage area of the conduit. In the present embodiment, the proportional valve 33AL operates according to a control instruction that is output by the controller 30. Therefore, regardless of the operator's operation of the operating apparatus 26, the controller 30 can supply the pressure force of the hydraulic oil discharged by the operating apparatus 26 to the pilot port of the corresponding control valve within the control valve unit 17 via the shuttle valve 32AL upon decreasing the pressure force.

Likewise, the proportional valve 33AR functions as a control valve for machine control. The proportional valve 33AR is arranged in a conduit connecting the operating apparatus 26 and the shuttle valve 32AR and configured to be able to change the flow passage area of the conduit. In the present embodiment, the proportional valve 33AR operates according to a control instruction that is output by the controller 30. Therefore, regardless of the operator's operation of the operating apparatus 26, the controller 30 can supply the pressure force of the hydraulic oil discharged by the operating apparatus 26 to the pilot port of the corresponding control valve within the control valve unit 17 via the shuttle valve 32AR upon decreasing the pressure force.

The operation pressure sensor 29A detects, in a form of pressure force (operation pressure), operator's operation content on the lever device 26A. A detection signal corresponding to the detected pressure force is input to the controller 30. Accordingly, the controller 30 can find the operation content on the lever device 26A.

Regardless of the operator's boom raising operation on the lever device 26A, the controller 30 can supply the hydraulic oil discharged from the pilot pump 15 via the proportional valve 31AL and the shuttle valve 32A1 to the pilot port at the right side of the control valve unit 175L and the pilot port at the left side of the control valve unit 175R. Regardless of the operator's boom lowering operation on the lever device 26A, the controller 30 can supply the hydraulic oil discharged from the pilot pump 15 via the proportional valve 31AR and the shuttle valve 32AR to the pilot port at the right side of the control valve unit 175R. In other words, the controller 30 can automatically control raising and lowering operation of the boom 4. Even in a case where a particular operation is performed on the operating apparatus 26, the controller 30 can forcibly stop the operation of the hydraulic actuator corresponding to the particular operation of the operating apparatus 26.

The proportional valve 33AL operates according to a control instruction (i.e., a current instruction) that is output by the controller 30. The proportional valve 33AL reduces the pilot pressure applied by the hydraulic oil introduced to the pilot port at the right side of the control valve unit 175L and the pilot port at the left side of the control valve unit 175R via the lever device 26A, the proportional valve 33AL, and the shuttle valve 32AL from the pilot pump 15. The proportional valve 33AR operates according to a control instruction (i.e., a current instruction) that is output by the controller 30. The proportional valve 33AR reduces the pilot pressure applied by the hydraulic oil introduced to the pilot port at the right side of the control valve unit 175R via the lever device 26A, the proportional valve 33AR, and the shuttle valve 32AR from the pilot pump 15. The proportional valves 33AL, 33AR can adjust the pilot pressure, so that the control valves 175L, 175R can be stopped at any given valve position.

According to this configuration, even in a case where the operator performs boom raising operation, the controller 30 can reduce, as necessary, the pilot pressure applied to the raising-side pilot port (the pilot port at the right side of the control valve unit 175L and the pilot port at the left side of the control valve unit 175R) of the control valve unit 175 to forcibly stop the closing operation of the boom 4. This also applies in a case where the lowering operation of the boom 4 is forcibly stopped when the operator performs the boom lowering operation.

Alternatively, even in a case where the operator performs boom raising operation, the controller 30 may control, as necessary, the proportional valve 31AR to increase the pilot pressure applied to the lowering-side pilot port of the control valve unit 175 (the pilot port at the right side of the control valve unit 175R) on the side opposite the raising-side pilot port of the control valve unit 175 to forcibly bring the control valve unit 175 back to the neutral position, thereby forcibly stop the raising operation of the boom 4. In this case, the proportional valve 33AL may not be provided. This also applies in a case where the lowering operation of the boom 4 is forcibly stopped when the operator performs the boom lowering operation.

As illustrated in FIG. 4B, the lever device 26B is used by the operator and the like to operate the bucket cylinder 9 corresponding to the bucket 6. The lever device 26B uses the hydraulic oil discharged from the pilot pump 15 to output the pilot pressure to the secondary side according to the operation content.

The two respective inlet ports of the shuttle valve 32BL are connected to the secondary-side pilot line of the lever device 26B and the secondary-side pilot line of the proportional valve 31BL corresponding to an operation in a direction to close the bucket 6 (hereinafter referred to as "bucket closing operation"). The output port of the shuttle valve 32BL is connected to the pilot port at the left side of the control valve unit 174.

The two respective inlet ports of the shuttle valve 32BR are connected to the secondary-side pilot line of the lever device 26B and the secondary-side pilot line of the proportional valve 31BR corresponding to an operation in a direction to open the bucket 6 (hereinafter referred to as "bucket opening operation"). The output port of the shuttle valve 32BR is connected to the pilot port at the right side of the control valve unit 174.

Specifically, the lever device 26B applies the pilot pressure according to the operation content to the pilot ports of the control valve unit 174 via the shuttle valve 32BL, 32BR. Specifically, in a case where the bucket closing operation is performed with the lever device 26B, the lever device 26B outputs the pilot pressure according to the amount of operation to one of the inlet ports of the shuttle valve 32BL to apply the pilot pressure to the pilot port at the left side of the control valve unit 174 via the shuttle valve 32BL. In a case where the bucket opening operation is performed with the lever device 26B, the lever device 26B outputs the pilot pressure according to the amount of operation to one of the inlet ports of the shuttle valve 32BR applies to apply the pilot pressure to the pilot port at the right side of the control valve unit 174 to the pilot port at the right side of the control valve unit 174 via the shuttle valve 32BR.

The proportional valve 31BL operates according to a control current received from the controller 30. Specifically, the proportional valve 31BL uses the hydraulic oil discharged from the pilot pump 15 to output a pilot pressure according to a control current received from the controller 30 to the other of the pilot ports of the shuttle valve 32BL. Accordingly, the proportional valve 31BL can adjust the pilot pressure applied to the pilot port at the left side of the control valve unit 174 via the shuttle valve 32BL.

The proportional valve 31BR operates according to a control current received from the controller 30. Specifically, the proportional valve 31BR uses the hydraulic oil discharged from the pilot pump 15 to output a pilot pressure according to a control current received from the controller 30 to the other of the pilot ports of the shuttle valve 32BR. Accordingly, the proportional valve 31BR can adjust the pilot pressure applied to the pilot port at the right side of the control valve unit 174 via the shuttle valve 32BR.

Therefore, regardless of the operation state of the lever device 26B, the proportional valves 31BL, 31BR can adjust the pilot pressure that is output at the secondary side, so that the control valve unit 174 can be stopped at any given valve position.

Like the proportional valve 31BL, the proportional valve 33BL functions as a control valve for machine control. The proportional valve 33BL is arranged in a conduit connecting the operating apparatus 26 and the shuttle valve 32BL and configured to be able to change the flow passage area of the conduit. In the present embodiment, the proportional valve 33BL operates according to a control instruction that is output by the controller 30. Therefore, regardless of the operator's operation of the operating apparatus 26, the controller 30 can supply the pressure force of the hydraulic oil discharged by the operating apparatus 26 to the pilot port of the corresponding control valve within the control valve unit 17 via the shuttle valve 32BL upon decreasing the pressure force.

Likewise, the proportional valve 33BR functions as a control valve for machine control. The proportional valve 33BR is arranged in a conduit connecting the operating apparatus 26 and the shuttle valve 32BR and configured to be able to change the flow passage area of the conduit. In the present embodiment, the proportional valve 33BR operates according to a control instruction that is output by the controller 30. Therefore, regardless of the operator's operation of the operating apparatus 26, the controller 30 can supply the pressure force of the hydraulic oil discharged by the operating apparatus 26 to the pilot port of the corresponding control valve within the control valve unit 17 via the shuttle valve 32BR upon decreasing the pressure force.

The operation pressure sensor 29B detects, in a form of pressure force (operation pressure), operator's operation content on the lever device 26B. A detection signal corresponding to the detected pressure force is input to the controller 30. Accordingly, the controller 30 can find the operation content of the lever device 26B.

Regardless of operator's bucket closing operation on the lever device 26B, the controller 30 can supply the hydraulic oil discharged from the pilot pump 15 to the pilot port at the left side of the control valve unit 174 via the proportional valve 31BL and the shuttle valve 32BL. Regardless of operator's bucket closing operation on the lever device 26B, the controller 30 can supply the hydraulic oil discharged from the pilot pump 15 to the pilot port at the right side of the control valve unit 174 via the proportional valve 31BR and the shuttle valve 32BR. In other words, the controller 30 can automatically control opening and closing operation of the bucket 6. Even in a case where a particular operation is performed on the operating apparatus 26, the controller 30 forcibly stop the operation of the hydraulic actuator corresponding to the particular operation of the operating apparatus 26.

The operation of the proportional valves 33BL, 33BR for forcibly stopping the operation of the bucket 6 in a case where the operator performs the bucket closing operation or the bucket opening operation is similar to the operation of the proportional valves 33AL, 33AR for forcibly stopping the operation of the boom 4 in a case where the operator performs the boom raising operation or the boom lowering operation, and therefore, explanation thereabout is omitted.

Also, for example, as illustrated in FIG. 4C, the lever device 26C is used by the operator and the like to operate the turning hydraulic motor 2A corresponding to the upper turning body 3 (i.e., the turning mechanism 2). The lever device 26C uses the hydraulic oil discharged from the pilot pump 15 to output the pilot pressure to the secondary side according to the operation content.

The two respective inlet ports of the shuttle valve 32CL are connected to the secondary-side pilot line of the lever device 26C and the secondary-side pilot line of the proportional valve 31CL corresponding to a turning operation in the left direction of the upper turning body 3 (hereinafter referred to as "left turning operation"). The output port of the shuttle valve 32CL is connected to the pilot port at the left side of the control valve unit 173.

The two respective inlet ports of the shuttle valve 32CR are connected to the secondary-side pilot line of the lever device 26C and the secondary-side pilot line of the proportional valve 31CR corresponding to a turning operation in the right direction of the upper turning body 3 (hereinafter referred to as "right turning operation"). The output port of the shuttle valve 32CR is connected to the pilot port at the right side of the control valve unit 173.

In other words, the lever device 26C applies, to the pilot port of the control valve unit 173 via the shuttle valves 32CL, 32CR, the pilot pressure according to the operation content in the lateral direction. Specifically, in a case where the left turning operation is performed with the lever device 26C, the lever device 26C outputs the pilot pressure according to the amount of operation to one of the inlet ports of the shuttle valve 32CL to apply the pilot pressure to the pilot port at the left side of the control valve unit 173 via the shuttle valve 32CL. In a case where right turning operation is performed, the lever device 26C outputs the pilot pressure according to the amount of operation to one of the inlet ports of the shuttle valve 32CR to apply the pilot pressure to the pilot port at the right side of the control valve unit 173 via the shuttle valve 32CR.

The proportional valve 31CL operates according to a control current received from the controller 30. Specifically, the proportional valve 31CL uses the hydraulic oil discharged from the pilot pump 15 to output a pilot pressure according to a control current received from the controller 30 to the other of the pilot ports of the shuttle valve 32CL. Accordingly, the proportional valve 31CL can adjust the pilot pressure applied to the pilot port at the left side of the control valve unit 173 via the shuttle valve 32CL.

The proportional valve 31CR operates according to a control current received from the controller 30. Specifically, the proportional valve 31CR uses the hydraulic oil discharged from the pilot pump 15 to output a pilot pressure according to a control current received from the controller 30 to the other of the pilot ports of the shuttle valve 32CR. Accordingly, the proportional valve 31CR can adjust the pilot pressure applied to the pilot port at the right side of the control valve unit 173 via the shuttle valve 32CR.

Therefore, regardless of the operation state of the lever device 26C, the proportional valves 31CL, 31CR can adjust the pilot pressure that is output at the secondary side, so that the control valve unit 173 can be stopped at any given valve position.

Like the proportional valve 31CL, the proportional valve 33CL functions as a control valve for machine control. The proportional valve 33CL is arranged in a conduit connecting the operating apparatus 26 and the shuttle valve 32CL and configured to be able to change the flow passage area of the conduit. In the present embodiment, the proportional valve 33CL operates according to a control instruction that is output by the controller 30. Therefore, regardless of the operator's operation of the operating apparatus 26, the controller 30 can supply the pressure force of the hydraulic oil discharged by the operating apparatus 26 to the pilot port of the corresponding control valve within the control valve unit 17 via the shuttle valve 32CL upon decreasing the pressure force.

Likewise, the proportional valve 33CR functions as a control valve for machine control. The proportional valve 33CR is arranged in a conduit connecting the operating apparatus 26 and the shuttle valve 32CR and configured to be able to change the flow passage area of the conduit. In the present embodiment, the proportional valve 33CR operates according to a control instruction that is output by the controller 30. Therefore, regardless of the operator's operation of the operating apparatus 26, the controller 30 can supply the pressure force of the hydraulic oil discharged by the operating apparatus 26 to the pilot port of the corresponding control valve within the control valve unit 17 via the shuttle valve 32CR upon decreasing the pressure force.

The operation pressure sensor 29C detects, as pressure force, the operation state of the lever device 26C by the operator. A detection signal corresponding to the detected pressure force is input to the controller 30. Accordingly, the controller 30 can find the operation content on the lever device 26C in the lateral direction.

Regardless of the operator's left turning operation on the lever device 26C, the controller 30 can the hydraulic oil discharged from the pilot pump 15 to the pilot port at the left side of the control valve unit 173 via the proportional valve 31CL and the shuttle valve 32CL. Regardless of the operator's right turning operation on the lever device 26C, the controller 30 can supply the hydraulic oil discharged from the pilot pump 15 to the pilot port at the right side of the control valve unit 173 via the proportional valve 31CR and the shuttle valve 32CR. In other words, the controller 30 can automatically control the turning operation of the upper turning body 3 in the lateral direction. Even in a case where a particular operation is performed on the operating apparatus 26, the controller 30 can forcibly stop the operation of the hydraulic actuator corresponding to the particular operation of the operating apparatus 26.

The operation of the proportional valves 33CL, 33CR for forcibly stopping the operation of the upper turning body 3 in a case where the operator performs the turning operation is similar to the operation of the proportional valves 33AL, 33AR for forcibly stopping the operation of the boom 4 in a case where the operator performs the boom raising operation or the boom lowering operation, and therefore, explanation thereabout is omitted.

It should be noted that the shovel 100 may further include a configuration for automatically opening and closing the arm 5 and a configuration for automatically moving the lower traveling body 1 forward or backward. In this case, in the hydraulic system, a part constituting the operation system of the arm cylinder 8, a part constituting the operation system of the traveling hydraulic motor 1L, and a part constituting the operation of the traveling hydraulic motor 1R may be configured in a manner similar to a part constituting the operation system of the boom cylinder 7 (FIGS. 4A to 4C).

[Details of Configuration of Earth Load Detection Function of Shovel]

Figure 5:
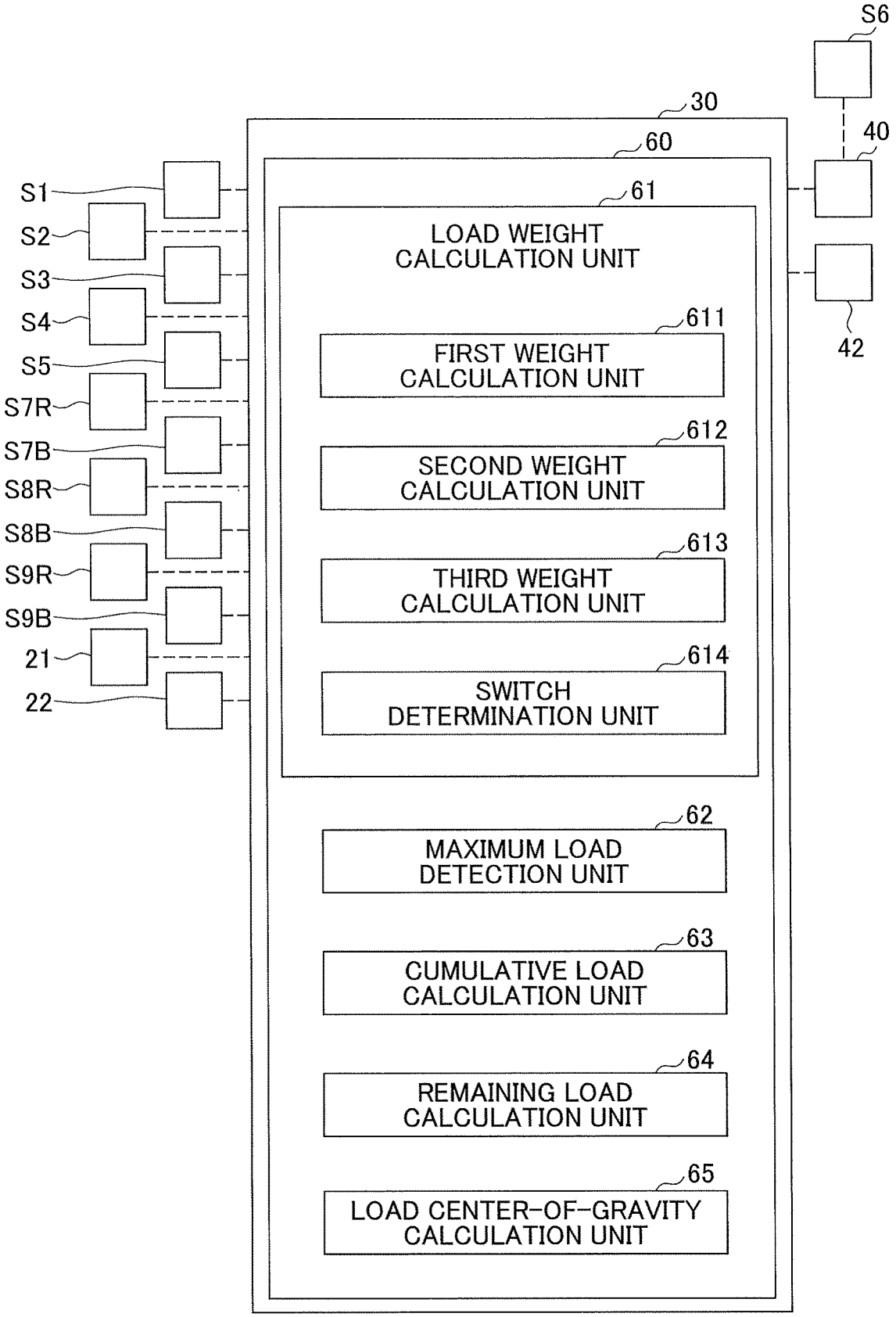
FIG. 5 is a drawing schematically illustrating an example of the earth load detection function of the shovel according to the present embodiment.

Next, the earth load detection function of the shovel 100 according to the present embodiment is explained in detail with reference to FIG. 5. FIG. 5 is a drawing schematically illustrating an example of the earth load detection function of the shovel 100 according to the present embodiment.

As described above with reference to FIG. 3, the controller 30 includes an earth load processing unit 60 as a function unit of a function for detecting the load of the earth excavated by the bucket 6.

The earth load processing unit 60 includes a load weight calculation unit 61, a maximum load detection unit 62, a cumulative load calculation unit 63, a remaining load calculation unit 64, and a load center-of-gravity calculation unit 65.

Here, an example of operation of loading work of earth (i.e., load) to a dump truck by the shovel 100 according to the present embodiment is explained.

First, at an excavation position, the shovel 100 controls the attachment to excavate the earth with the bucket 6 (excavation operation). Next, the shovel 100 turns the upper turning body 3 to move the bucket 6 from the excavation position to the unloading position (turning operation). The dump bed of the dump truck is arranged below the unloading position. Next, at an unloading position, the shovel 100 controls the attachment to unload the earth carried in the bucket 6, so that the earth carried in the bucket 6 is unloaded to the dump bed of the dump truck (unloading operation). Next, the shovel 100 turns the upper turning body 3 to move the bucket 6 from the unloading position to the excavation position (turning operation). By repeating such operations, the shovel 100 loads the excavated earth to the dump bed of the dump truck.

The load weight calculation unit 61 calculates the weight of the earth (i.e., the load) in the bucket 6. The load weight calculation unit 61 includes a first weight calculation unit 611, a second weight calculation unit 612, a third weight calculation unit 613, and a switch determination unit 614.

Any of the first weight calculation unit 611 to the third weight calculation unit 613 calculates the weight of the earth (i.e., the load) in the bucket 6. But the first weight calculation unit 611 to the third weight calculation unit 613 are different in the detection method for calculating the earth weight. The first weight calculation unit 611 to the third weight calculation unit 613 are different in the detection timing of the earth weight in the operation of the shovel 100. The first weight calculation unit 611 calculates the earth weight on the basis of the thrust of the boom cylinder 7. The second weight calculation unit 612 calculates the earth weight on the basis of the thrust while the upper turning body 3 is being turned. The third weight calculation unit 613 calculates the earth weight on the thrust of the bucket cylinder 9. It should be noted that the calculation methods of the earth weigh by the first weight calculation unit 611 to the third weight calculation unit 613 are explained later.

The switch determination unit 614 switches the mode of the timing for detecting the earth weight. In other words, the switch determination unit 614 determines and switches which of the earth weights calculated by the first weight calculation unit 611 to the third weight calculation unit 613 is adopted as the earth weight to be output by the load weight calculation unit 61.

In the load weight calculation unit 61, all of the first weight calculation unit 611 to the third weight calculation unit 613 may perform calculation of the earth weight at all times, and the switch determination unit 614 switches the mode to adopt any one of the earth weights calculated by the first weight calculation unit 611 to the third weight calculation unit 613 as the earth weight to be output by the load weight calculation unit 61.

Alternatively, the load weight calculation unit 61 may be configured to cause the switch determination unit 614 to switch the mode to switch the weight calculation unit calculating the earth weight. In other words, the load weight calculation unit 61 may be configured to enable the processing of any one of the first weight calculation unit 611 to the third weight calculation unit 613 and disable the remaining ones of the first weight calculation unit 611 to the third weight calculation unit 613. Still alternatively, the first weight calculation unit 611 may calculate the earth weight at all times regardless of the determination of the switch determination unit 614, and the second weight calculation unit 612 and the third weight calculation unit 613 may be configured to calculate the earth weight only when they are selected by the switch determination unit 614.

The maximum load detection unit 62 detects the maximum load of the target dump truck carrying the earth. For example, the maximum load detection unit 62 identifies the target dump truck carrying the earth on the basis of the image captured by the image-capturing device S6. Next, the maximum load detection unit 62 detects the maximum load of the dump truck on the basis of the image of the identified dump truck. For example, the maximum load detection unit 62 determines the vehicle type (e.g., the size and the like) on the basis of the image of the identified dump truck. The maximum load detection unit 62 includes a table in which the vehicle type and the maximum load are associated with each other, and derives the maximum load of the dump truck on the basis of the vehicle type determined from the image and the table. Alternatively, the maximum load of the dump truck, the vehicle type, and the like may be input with the input device 42, and the maximum load detection unit 62 may derive the maximum load of the dump truck on the basis of the input information of the input device 42.

The cumulative load calculation unit 63 calculates the earth weight carried on the dump truck. In other words, every time the earth carried in the bucket 6 is unloaded to the dump bed of the dump truck, the cumulative load calculation unit 63 cumulate the weights of the earths in the bucket 6 calculated by the load weight calculation unit 61 to calculate the cumulative load (total weight), i.e., a summation of earth weights carried on the dump bed of the dump truck. Also, when the target dump truck carrying the earth changes to a new dump truck, the cumulative load is reset.

The remaining load calculation unit 64 calculates, as the remaining load, the difference between the maximum load of the dump truck detected by the maximum load detection unit 62 and the current cumulative load calculated by the cumulative load calculation unit 63. The remaining load is a remaining weight of earth that can be carried by the dump truck.

The load center-of-gravity calculation unit 65 calculates the center of gravity of the earth (i.e., the load) in the bucket 6. For example, the load center-of-gravity calculation unit 65 may calculate the center of gravity of the earth on the basis of values such as the boom angle sensor S1, the arm angle sensor S2, the bucket angle sensor S3, and the like, on the basis of the assumption that a relative position between the position of the teeth end of the bucket 6 and the center of gravity of the earth is known. It should be noted that the calculation method is not limited thereto, and various methods may be used.

The display device 40 may display the weight of the earth carried in the bucket 6 calculated by the load weight calculation unit 61, the maximum load of the dump truck detected by the maximum load detection unit 62, the cumulative load of the dump truck (i.e., the summation of the earth weight carried on the dump bed of the dump truck) calculated by the cumulative load calculation unit 63, and the remaining load of the dump truck (the remaining weight of the earth that can be carried on the dump truck) calculated by the remaining load calculation unit 64.

The display device 40 may be configured to display warning in a case where the cumulative load exceeds the maximum load. The display device 40 may be configured to display warning in a case where the calculated weight of the earth carried in the bucket 6 is more than the remaining load. It should be noted that the warning is not limited to be displayed on the display device 40, and the warning may be audibly output by the audio output device 43. Therefore, the dump truck is prevented from carrying earth exceeding the maximum load of the dump truck.

[Earth Weight Calculation Method by First Weight Calculation Unit 611]

Figure 6B:
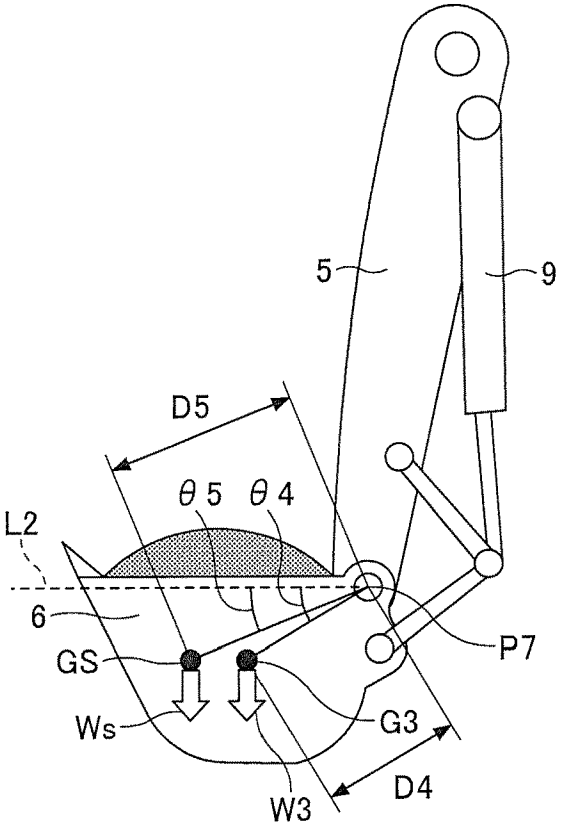
FIGS. 6A and 6B are schematic diagrams for explaining parameters relating to calculation of an earth weight on an attachment of the shovel.
Figure 6A:
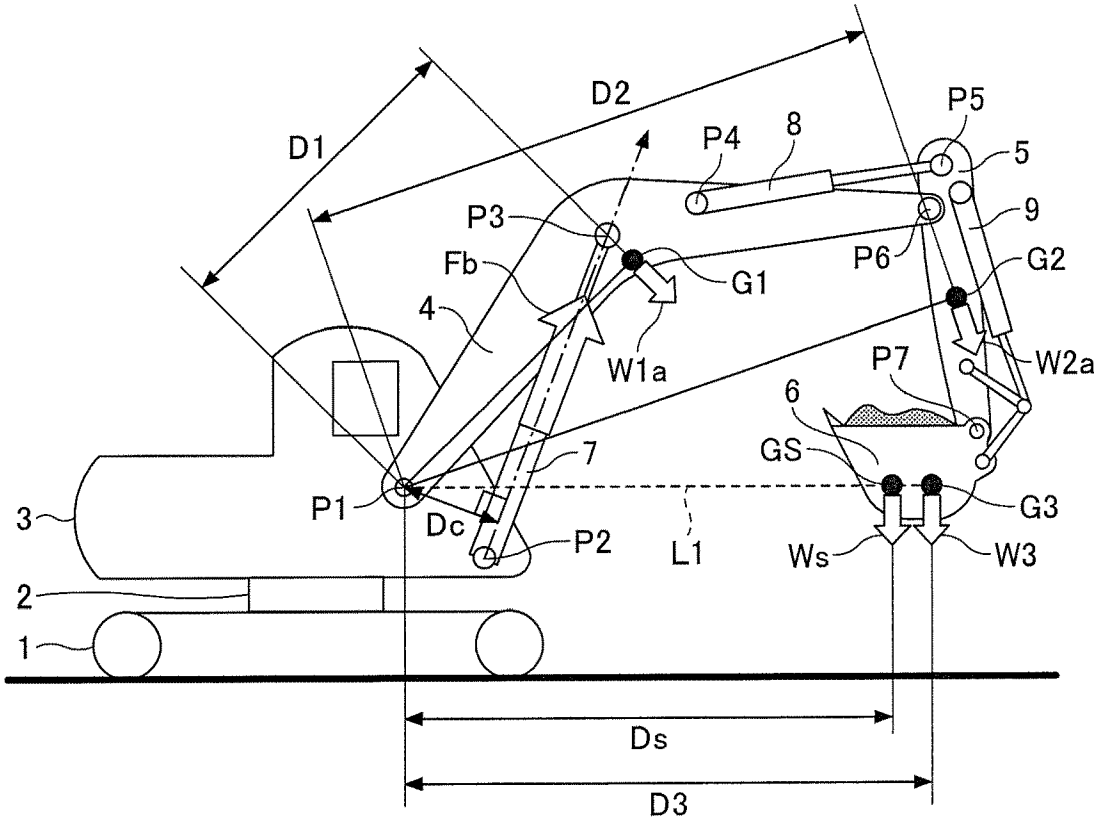

Next, the method for calculating the weight of the earth (i.e., the load) in the bucket 6 by the first weight calculation unit 611 of the shovel 100 according to the present embodiment is explained based on to FIGS. 6A and 6B with reference to FIG. 5.

FIGS. 6A and 6B are schematic diagrams for explaining parameters relating to calculation of the earth weight on the attachment of the shovel 100. FIG. 6A illustrates the shovel 100. FIG. 6B illustrates the bucket 6 and a portion around the bucket 6. In the following explanation, it is assumed that a pin P1, a bucket center-of-gravity G3, and an earth center-of-gravity Gs explained later are arranged on a horizontal line L1.

In this case, a pin connecting the upper turning body 3 and the boom 4 is denoted as P1. A pin connecting the upper turning body 3 and the boom cylinder 7 is denoted as P2. A pin connecting the boom 4 and the boom cylinder 7 is denoted as P3. A pin connecting the boom 4 and the arm cylinder 8 is denoted as P4. A pin connecting the arm 5 and the arm cylinder 8 is denoted as P5. A pin connecting the boom 4 and the arm 5 is denoted as P6. A pin connecting the arm 5 and the bucket 6 is denoted as P7. The center of gravity of the boom 4 is denoted as G1. The center of gravity of the arm 5 is denoted as G2. The center of gravity of the bucket 6 is denoted as G3. The center of gravity of the earth (i.e., the load) carried in the bucket 6 is denoted as Gs. A reference line L2 is a line passing through the pin P7 in parallel with an open side of the bucket 6. A distance between the pin P1 and a center-of-gravity G4 of the boom 4 is denoted as D1. A distance between the pin P1 and a center-of-gravity G5 of the arm 5 is denoted as D2. A distance between the pin P1 and a center-of-gravity G6 of the bucket 6 is denoted as D3. A distance between the pin P1 and the earth center-of-gravity Gs is denoted as Ds. A distance between the pin P1 and a straight line connecting the pin P2 and the pin P3 is denoted as Dc. A detected value of the cylinder pressure of the boom cylinder 7 is denoted as Fb. A component of the boom weight in a direction perpendicular to a straight line connecting the pin P1 and the boom center-of-gravity G1 is denoted as W1*a*. A component of the arm weight in a direction perpendicular to a straight line connecting the pin P1 and the arm center-of-gravity G2 is denoted as W2*a*. The weight of the bucket 6 is denoted as W6, and the weight of the earth (i.e., the load) carried in the bucket 6 is denoted as Ws.

As illustrated in FIG. 6A, the position of the pin P7 is calculated from the boom angle and the arm angle. In other words, the position of the pin P7 can be calculated on the basis of the detected values of the boom angle sensor S1 and the arm angle sensor S2.

As illustrated in FIG. 6B, a relative position between the pin P7 and the bucket center-of-gravity G3 (an angle θ4 between the reference line L2 of the bucket 6 and a straight line connecting the pin P7 and the bucket center-of-gravity G3; and a distance D4 between the pin P7 and the bucket center-of-gravity G3) is a value according to the specification. For example, a relative position between the pin P7 and the earth center-of-gravity Gs (an angle θ5 between the reference line L2 of the bucket 6 and a straight line connecting the pin P7 and the earth center-of-gravity Gs; and a distance D5 between the pin P7 and the earth center-of-gravity Gs) is derived through experiment in advance and stored in the controller 30. In other words, the earth center-of-gravity Gs and the bucket center-of-gravity G3 can be estimated on the basis of the bucket angle sensor S3.

In other words, the load center-of-gravity calculation unit 65 estimates the earth center-of-gravity Gs on the basis of the detected values of the boom angle sensor S1, the arm angle sensor S2 and the bucket angle sensor S3.

Next, an equilibrium between moments around the pin P1 and the boom cylinder 7 can be expressed by the following Expression (1).

$$WsDs+W1aD1+W2aD2+W3D3=FbDc \quad (1)$$

The following Expression (2) is obtained by developing the Expression (1) with respect to the earth weight Ws.

$$Ws=(FbDc-(W1aD1+W2aD2+W3D3))/Ds \quad (2)$$

In this case, the detected value Fb of the cylinder pressure of the boom cylinder 7 is calculated by the boom rod pressure sensor S7R and the boom bottom pressure sensor S7B. The distance Dc and the component W1*a* of the boom weight are calculated by the boom angle sensor S1. The component W2*a* of the arm weight and the distance D2 are calculated by the boom angle sensor S1 and the arm angle sensor S2. The distance D1 and the weight W3 are known values. The earth center-of-gravity Gs and the bucket center-of-gravity G3 are estimated, and accordingly, the distance Ds and the distance D3 are also estimated.

Therefore, the earth weight Ws can be calculated on the basis of the detected value of the cylinder pressure of the boom cylinder 7 (i.e., the detected values of the boom rod pressure sensor S7R and the boom bottom pressure sensor S7B), the boom angle (i.e., the detected value of the boom angle sensor S1), and the arm angle (i.e., the detected value of the arm angle sensor S2). Accordingly, the load weight calculation unit 61 can calculate the earth weight Ws on the basis of the earth center-of-gravity Gs estimated by the load center-of-gravity calculation unit 65.

It should be noted that whether or not shovel 100 is in a specified operation can be determined by estimating the orientation of the attachment based on the detected value of the pilot pressure of bucket cylinder 9.

In the above explanation, the earth center-of-gravity is estimated and the earth weight is calculated based on the assumption that the orientation of the bucket 6 in the specified operation is horizontal. However, the present disclosure is not limited thereto. For example, the image of the bucket 6 may be captured by the camera S6F for capturing images in the forward direction, the orientation of the bucket 6 may be estimated on the basis of the image. Also, for example, the image of the bucket 6 may be captured by the camera S6F, and in a case where the orientation of the bucket 6 is determined to be horizontal on the basis of the captured image, the earth center-of-gravity may be estimated and the earth load may be calculated.

[Earth Weight Calculation Method by Second Weight Calculation Unit 612]

Next, a method for calculating the weight of the earth (i.e., the load) in the bucket 6 by the second weight calculation unit 612 of the shovel 100 according to the present embodiment is explained.

In this case, the equation of motion of the turning torque τ for turning the upper turning body 3 can be expressed by the following Expression (3). The attachment angle θ includes a boom angle, an arm angle, and a bucket angle.

[Math 1]

$$J(\theta)\ddot{\omega}+h(\theta,\dot{\theta},\dot{\omega})\dot{\omega}=\tau \quad (3)$$

where ω denotes a turning angle,

θ denotes an attachment angle,

J(θ) denotes a term of inertia, h(θ, $\dot{\theta}$) denotes a term of Coriolis and centrifugal forces, and τ denotes a turning torque.

Also, the equation of motion of the turning torque τ0 for turning the upper turning body 3 without any earth carried in the bucket 6 (without any load) can be expressed by the following Expression (4).

[Math 2]

$$J_0(\theta)\ddot{\omega}+h_0(\theta,\dot{\theta},\dot{\omega})\dot{\omega}=\tau_0 \quad (4)$$

Also, the equation of motion of the turning torque τW for turning the upper turning body 3 with earth carried in the bucket 6 can be expressed by the following Expression (5).

[Math 3]

$$(J_0(\theta)+J_W(\theta,M))\ddot{\omega}+(h_0(\theta,\dot{\theta},\dot{\omega})+h_W(\theta,\dot{\theta},\dot{\omega},M))\dot{\omega}=\tau_W \quad (5)$$

where $J_W(\theta, M)$, $h_W(\theta,\dot{\theta},\dot{\omega}, M)$ denotes an increment due to the load, and M denotes the weight of the load.

In this case, the difference Δτ between the turning torque τw with the earth and the turning torque τ0 without the earth can be calculated by the following Expression (6), which is derived from the above Expressions (4) and (5).

[Math 4]

$$\Delta\tau=\tau_W-\tau_0=J_W(\theta,M)\ddot{\omega}+h_W(\theta,\dot{\theta},\dot{\omega},M)\dot{\omega} \quad (6)$$

In this case, the parameters other than the load weight M in the Expression (6) are known or measurable, and therefore, the load weight M can be calculated.

In other words, the second weight calculation unit 612 obtains the turning driving force of the upper turning body 3 in the turning operation of the upper turning body 3. In this case, the turning driving force of the upper turning body 3 is obtained from a pressure force difference between one of the ports and the other of the ports of the turning hydraulic motor 2A. In other words, the turning driving force of the upper turning body 3 is obtained from the hydraulic difference detected by the hydraulic sensors 21, 22.

The second weight calculation unit 612 obtains the orientation of the attachment with an orientation sensor. For example, the attachment angle (i.e., the boom angle, the arm angle, and the bucket angle) may be obtained with the boom angle sensor S1, the arm angle sensor S2, and the bucket angle sensor S3. The inclination angle of the body may be obtained with the body inclination sensor S4. The second weight calculation unit 612 may obtain the turning angular speed and the turning angle of the upper turning body 3 with the turning state sensor S5.

The second weight calculation unit 612 has a table in advance. In the table, the load weight M is associated with the orientation of the attachment and the turning driving force.

Accordingly, the second weight calculation unit 612 can calculate the load weight M on the basis of the turning driving force, information obtained from the orientation sensor, and the table.

Also, the second weight calculation unit 612 may derive the turning inertia based on the turning driving force, and may calculate the load weight M on the basis of the derived turning inertia.

In this case, the turning inertia without any earth carried in the bucket 6 can be derived from the orientation of the attachment and known information (the center-of-gravity position, the weight, and the like of each unit). The turning inertia with earth carried in the bucket 6 can be derived from the turning torque.

An increment from the turning inertia without any earth to the turning inertia with earth is based on the weight of the earth carried in the bucket 6. Therefore, the load weight M can be calculated by comparing the turning inertia without any earth and the turning inertia with earth. In other words, the load weight M can be calculated on the basis of difference in the turning inertia.

In this case, the turning driving force includes the influence of the moment of inertia and the turning centrifugal force. Therefore, according to the calculation method for calculating the earth weight by the second weight calculation unit 612, the load weight M can be directly derived without requiring complicated compensation to calculate the weight of the load weight M.

In the above explanation, the case where the upper turning body 3 of the shovel 100 turns has been explained. However, the present disclosure is not limited thereto. For example, in a case where the upper turning body 3 turns and the attachment has a speed component in a direction other than the turning direction, the load weight M may be derived in view of the speed of the attachment. For example, in a case where the bucket 6 moves in an upward direction or downward direction along the rotation axis of the upper turning body 3 while the bucket 6 moves in a direction away from or in a direction approaching the rotation axis of the upper turning body 3, the load weight M may be derived in view of the speed of the bucket 6.

[Earth Weight Calculation Method of Third Weight Calculation Unit 613]

Figure 7B:
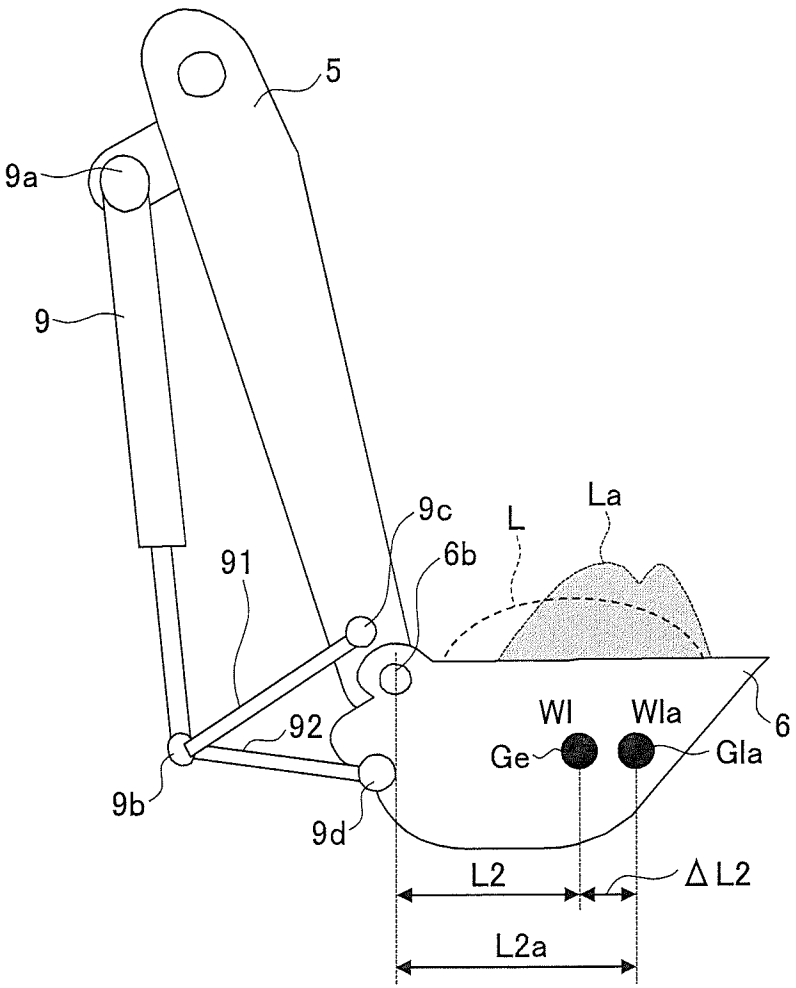
FIGS. 7A and 7B are partially enlarged views for explaining a relationship of force exerted on the bucket.
Figure 7A:
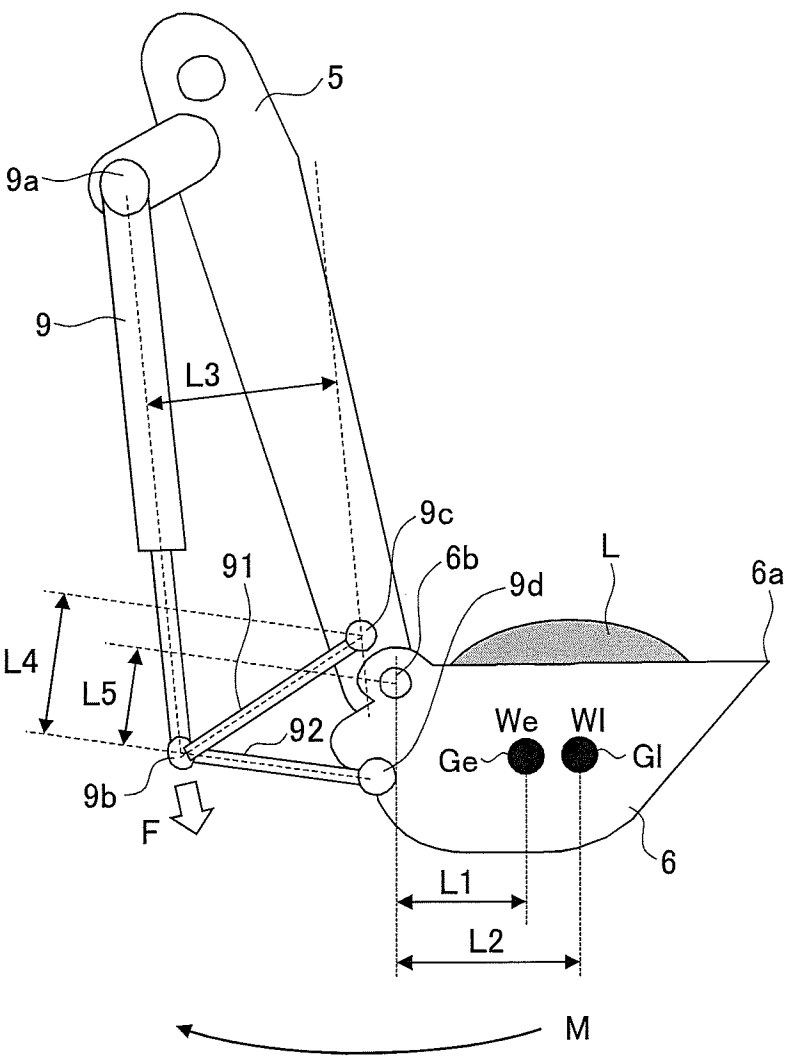

Next, a method for calculating the weight of the earth (i.e., the load) in the bucket 6 by the third weight calculation unit 613 of the shovel 100 according to the present embodiment is explained based on to FIGS. 7A and 7B with reference to FIG. 5.

FIGS. 7A and 7B are partially enlarged views for explaining a relationship of force exerted on the bucket 6. FIG. 7A illustrates a case where the shape of the earth carried in the bucket 6 is a first shape (reference shape). FIG. 7B illustrates a case where the shape of the earth carried in the bucket 6 is a second shape (an example of a shape during earth weight measurement).

As illustrated in FIG. 7A, the backward-side end of the bucket cylinder 9 is linked to the backward-side end of the aria 5 by a linkage pin 9*a*. The forward-side end of the bucket cylinder 9 is linked to first ends of two links 91, 92 with a linkage pin 9*b*. The first end of the link 91 is linked to the forward-side end of the bucket cylinder 9 with the linkage pin 9*b*. The second end of the link 91 is linked to an approximate forward-side end of the arm 5 with a linkage pin 9*c*. The first end of the link 92 is linked to the forward-side end of the bucket cylinder 9 with the linkage pin 9*b*. The second end of the link 92 is linked to an approximate proximal end of the bucket 6 with a linkage pin 9*d*.

As illustrated in FIG. 7A, the horizontal line L1 denotes a horizontal distance between the center-of-gravity Ge of the bucket 6 and the center of the bucket support axis 6*b*. The reference line L2 denotes a horizontal distance between the center-of-gravity G1 of the earth L in the bucket 6 and the center of the bucket support axis 6*b*. A line L3 denotes a distance between the center of the linkage pin 9*c* and a line segment (i.e., a central axis of the bucket cylinder 9) passing through the center of the linkage pin 9*a* and the center of the linkage pin 9*b*. A line L4 denotes a distance between the center of the linkage pin 9*c* and a line segment (i.e., a central axis of the link 92) passing through the center of the linkage pin 9*b* and the center of the linkage pin 9*d*. A line L5 denotes a distance between the center of the bucket support axis 6*b* and the line segment (i.e., the central axis of the link 92) passing through the center of the linkage pin 9*b* and the center of the linkage pin 9*d*.

In a case where the bucket 6 of the shovel 100 is maintained in a predetermined or given load holding orientation regardless of the inclination angle of the arm 5, for example, in a case where the bucket 6 is maintained in a predetermined or given horizontal orientation such that the bucket front end 6*a* is at the same height as the bucket support axis 6*b*, the moment M caused by the weight on the side of the bucket 6 and the moment caused by the reaction force F of the bucket cylinder 9 for maintaining the bucket 6 in the load holding orientation are exerted around the bucket support axis 6*b*. Because the bucket 6 is balanced in this state, both moments are in the opposite directions and are of the same magnitude according to the balanced condition.

The moment M caused by the weight on the side of the bucket 6 can be divided into a moment Me caused by a weight We of the bucket 6 and a moment Ml caused by a weight Wl of the earth L. Therefore, the moment M can be expressed by the following Expression (7).

$$M=Me+Ml \tag{7}$$

Next, the moment caused by the reaction force F of the bucket cylinder 9 for maintaining the bucket 6 in the load holding orientation is explained. First, where the moment around the center of the linkage pin 9*c* of the link 91 caused by the reaction force F of the bucket cylinder 9 is denoted as mc, the moment mc can be expressed by the following Expression (8-1).

$$mc=F\cdot L3 \tag{8-1}$$

The link 91 and the link 92 are rotatably linked by the center of the linkage pin 9*b*. Where a reaction force exerted from the linkage pin 9*b* of the link 92 in the direction of the linkage pin 9*d* is denoted as fbd, the reaction force fbd can be expressed as the following Expression (8-2) based on the balance with the moment mc around the center of the linkage pin 9*c*.

$$fbd \cdot L4 = mc \tag{8-2}$$

Further, around the center of the bucket support axis 6*b*, a reaction force fcd exerted on the center of the linkage pin 9*d* and the moment M of the bucket 6 are balanced. Accordingly, the reaction force fcd can be expressed by the following Expression (8-3).

$$fcd \cdot L5 = M \tag{8-3}$$

The balancing can be expressed as the following Expression (8) by combining Expressions (8-1) to (8-3).

$$F \cdot L3 \cdot L5 / L4 = M \tag{8}$$

In this case, where the bucket 6 is maintained in a predetermined or given load holding orientation, the positions of the linkage pins 9*a* to 9*d* with respect to the position of the bucket support axis 6*b* can be uniquely derived from the orientation sensors (for example, the boom angle sensor S1, the arm angle sensor S2, the bucket angle sensor S3, the body inclination sensor S4, and the turning state sensor S5), and accordingly, the distances L3, L4, L5 can be derived.

Also, where the load pressure detected based on the pressure force sensors of the bucket cylinder 9 (for example, the bucket rod pressure sensor S9R and the bucket bottom pressure sensor S9B) is denoted as P, and the size of the pressure receiving area of the piston of the bucket cylinder 9 is denoted as S, the reaction force F of the bucket cylinder 9 can be expressed by the following Expression (9).

$$F = P \times S \tag{9}$$

In the manner as described above, the moment exerted by the reaction force F of the bucket cylinder 9 can be derived from Expressions (8), (9), on the basis of the detected values detected by the orientation sensors and the pressure force sensors of the bucket cylinder 9.

The moment Me caused by the weight We of the bucket 6 can be expressed by the following Expression (10). The moment Ml caused by the weight Wl of the earth L can be expressed by the following Expression (11).

$$Me = We \times L1 \tag{10}$$

$$Ml = W1 \times L2 \tag{11}$$

In a case where the bucket 6 is maintained in the predetermined or given load holding orientation, the distance L1 can be derived from the orientation sensors. For example, the distance L2 may be derived through experiment in advance and stored in the controller 30. Alternatively, the distance L2 may be derived on the basis of the center-of-gravity of the earth calculated by the load center-of-gravity calculation unit 65 explained later.

In the manner as described above, the weight Wl of the earth L can be derived from Expressions (7) to (11) on the basis of the detected values of the orientation sensors and the pressure force sensors of the bucket cylinder 9. In the above explanation, the case where the earth weight is derived on the basis of the pressure force of the bucket cylinder 9 has been explained. However, the present disclosure is not limited thereto. For example, the weight Wl of the earth L may be derived on the basis of the detected values of the orientation sensors and the pressure force sensors of the boom cylinder 7. Alternatively, the weight Wl of the earth L may be derived on the basis of the detected values of the orientation sensors and the pressure force sensors of the arm cylinder. The relational expressions in such cases may be derived in a similar manner, and explanation thereabout is omitted.

[Earth Weight Calculation Method]

Next, a method for calculating the weight of the earth (i.e., the load) in the bucket 6 by the first weight calculation unit 611 for calculating earth weight on the basis of the thrust of the boom cylinder 7 is explained with reference to FIG. 8.

Figure 8:
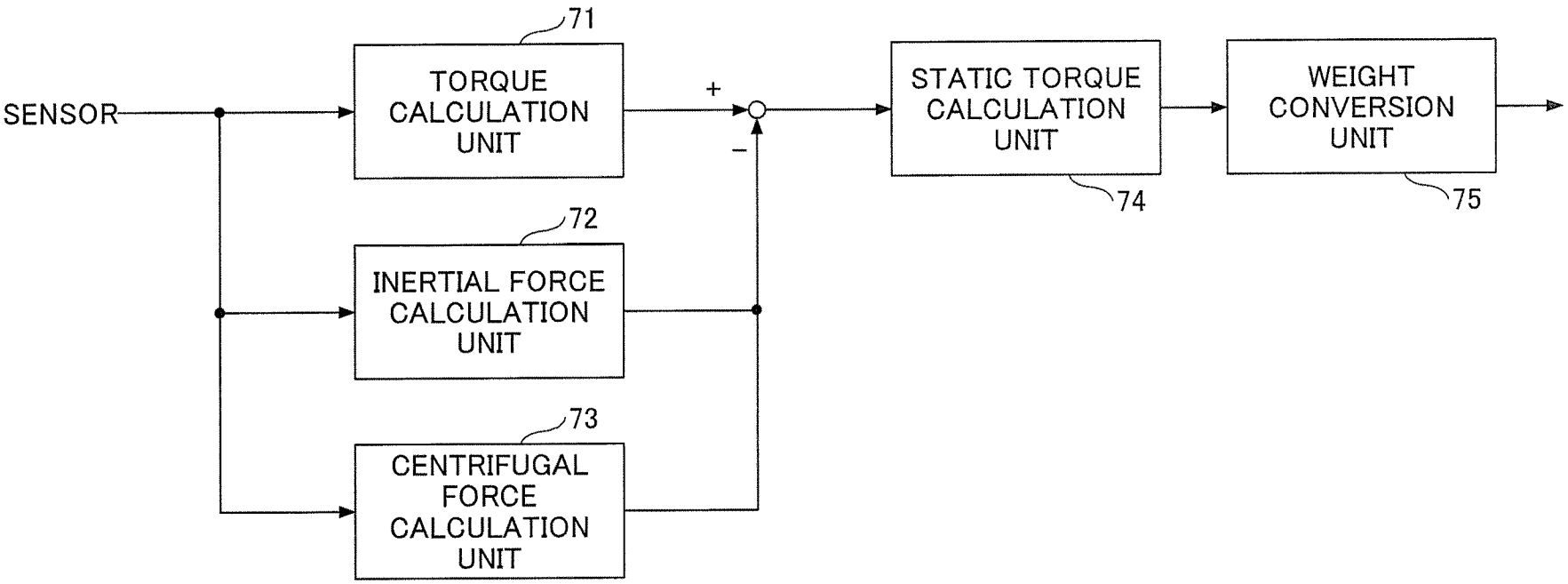
FIG. 8 is a block diagram for explaining processing of a first weight calculation unit.

FIG. 8 is a block diagram for explaining processing of the first weight calculation unit 611. The first weight calculation unit 611 includes a torque calculation unit 71, an inertial force calculation unit 72, a centrifugal force calculation unit 73, a static torque calculation unit 74, and a weight conversion unit 75.

The torque calculation unit 71 calculates a torque (detected torque) around the foot pin of the boom 4. For example, the torque (detected torque) is calculated on the basis of the pressure force of the hydraulic oil of the boom cylinder 7 (detected by the boom rod pressure sensor S7R and the boom bottom pressure sensor S7B).

The inertial force calculation unit 72 calculates the torque (inertial term torque) around the foot pin of the boom 4 caused by the inertial force. The inertial term torque is calculated on the basis of the angular acceleration around the foot pin of the boom 4 and the moment of inertia of the boom 4. The angular acceleration around the foot pin of the boom 4 and the moment of inertia are calculated on the basis of the output of the orientation sensor.

The centrifugal force calculation unit 73 calculates the torque (centrifugal term torque) around the foot pin of the boom 4 caused by the Coriolis and centrifugal forces. The centrifugal term torque is calculated on the basis of the angular speed around the foot pin of the boom 4 and the weight of the boom 4. The angular speed around the foot pin of the boom 4 is calculated on the basis of the output of the orientation sensor. The weight of the boom 4 is known.

The static torque calculation unit 74 calculates the static torque τW, which is a torque around the foot pin of the boom 4 while the attachment is stationary, on the basis of the detected torque detected by the torque calculation unit 71, the inertial term torque calculated by the inertial force calculation unit 72, and the centrifugal term torque calculated by the centrifugal force calculation unit 73. In this case, the torque around the foot pin of the boom 4 is defined by Expression (12). τ at the left-hand side of Expression (12) denotes the detected torque. The first term at the right-hand side denotes the inertial term torque. The second term at the right-hand side denotes the centrifugal term torque. The third term at the right-hand side denotes the static torque τW.

[Math 5]

$$\tau = J\ddot{\theta} + (\dot{\theta}, \theta)\dot{\theta} + \tau_W \tag{12}$$

As can be understood from Expression (12), the static torque τW can be derived by subtracting the inertial term torque and the centrifugal term torque from the detected torque τ. Accordingly, in the present embodiment, the influence caused by rotation operation around the pin such as the boom and the like can be compensated.

The weight conversion unit 75 calculates the earth weight Wl on the basis of the static torque τW. For example, the earth weight Wl can be calculated by dividing a torque, obtained by subtracting the torque without any earth carried in the bucket 6 from the static torque τW, by the horizontal distance from the foot pin of the boom 4 to the earth center-of-gravity.

In this manner, the first weight calculation unit 611 can calculate the earth weight by compensating the inertial term and the centrifugal term during operation of the boom 4. Although explanation is omitted, the third weight calculation unit 613 may likewise calculate the earth weight by compensating the inertial term and the centrifugal term during the operation of the bucket 6.

[Switch Determination Unit]

Figure 9:
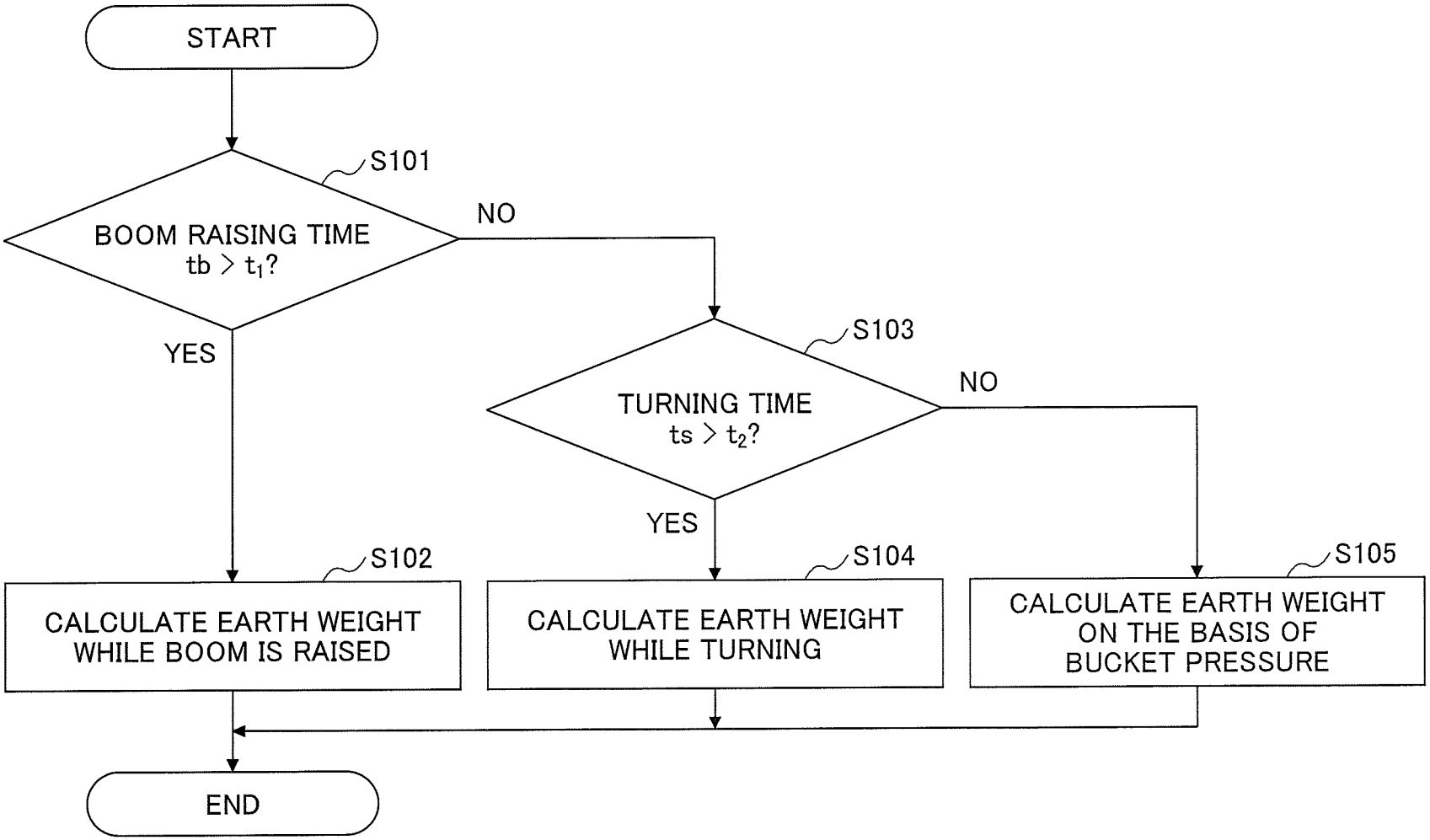
FIG. 9 is a flowchart for explaining processing of a switch determination unit.

Next, switching of the switch determination unit 614 of the shovel 100 according to the present embodiment is explained with reference to FIG. 9. FIG. 9 is a flowchart for explaining processing of the switch determination unit 614.

In step S101, the switch determination unit 614 determines whether a boom raising time tb is longer than a predetermined or given threshold time $t_1$. In a case where the boom raising time tb is longer than threshold time $t_1$ (Yes in S101), the switch determination unit 614 proceeds to step S102. In step S102, the switch determination unit 614 determines to calculate the earth weight while the boom 4 is being raised. In other words, the switch determination unit 614 switches to a mode for calculating the earth weight while the boom 4 is being raised, and adopts the earth weight calculated by the first weight calculation unit 611 as the earth weight that is output by the load weight calculation unit 61.

In a case where the boom raising time tb is equal to or less than the threshold time $t_1$ (No in S101), the switch determination unit 614 proceeds to step S103.

In step S103, the switch determination unit 614 determines whether a turning time ts is longer than a predetermined or given threshold time $t_2$. In a case where the turning time ts is longer than the threshold time $t_2$ (Yes in S103), the switch determination unit 614 proceeds to step S104. In step S104, the switch determination unit 614 determines to calculate the earth weight while the upper turning body 3 is being turned. In other words, the switch determination unit 614 switches to a mode for calculating the earth weight while the upper turning body 3 is being turned, and adopts the earth weight calculated by the second weight calculation unit 612 as the earth weight that is output by the load weight calculation unit 61.

In a case where the turning time ts is equal to or less than the threshold time $t_2$ (No in S103), the switch determination unit 614 proceeds to step S105. In step S105, the switch determination unit 614 determines that the earth weight is to be calculated on the basis of the bucket pressure. In other words, the switch determination unit 614 switches to a mode for calculating the earth weight on the basis of the bucket pressure, and adopts the earth weight calculated by the third weight calculation unit 613 as the earth weight that is output by the load weight calculation unit 61.

In the above explanation, the determination is made on the basis of the boom raising time tb in step S101. However, the present disclosure is not limited thereto. The switch determination unit 614 may determine whether a boom raise height hb is larger than a predetermined or given threshold height value $h_1$.

In the above explanation, the determination is made on the basis of the turning time ts in step S103. However, the present disclosure is not limited thereto. In step S103, the switch determination unit 614 may determine whether a turning angle θs is larger than a predetermined or given threshold angle value $\theta_2$.

[Operation Example of Shovel]

Figure 10A:
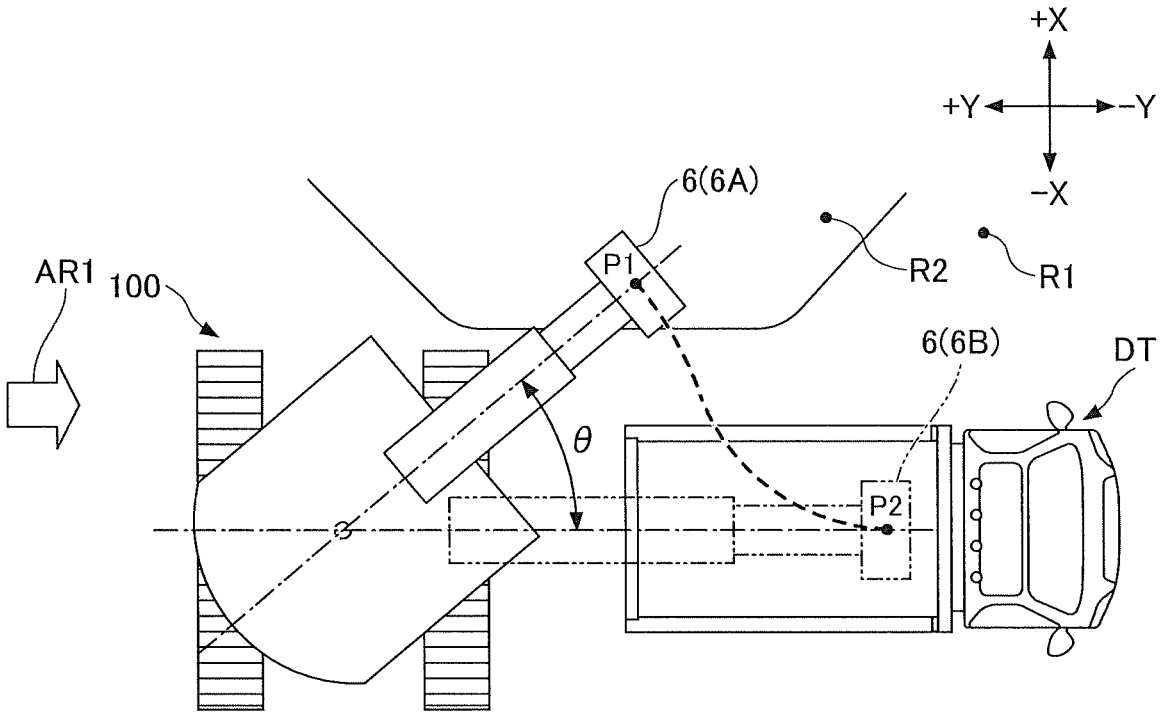
FIGS. 10A and 10B are schematic diagrams illustrating an example of a situation in a work site when a loading work for loading earth onto a dump truck is performed by a shovel.
Figure 10B:
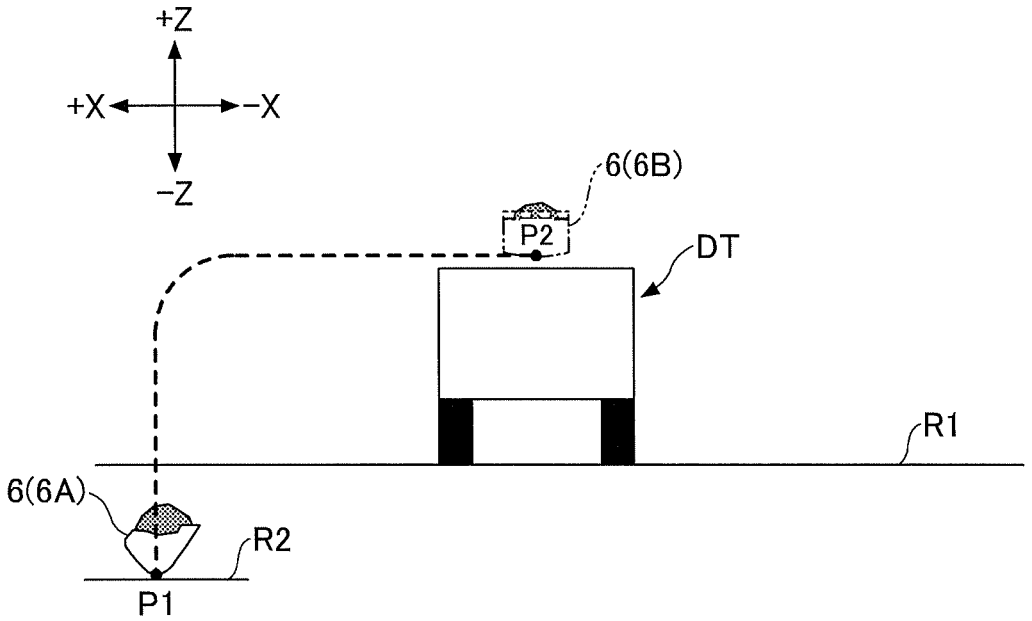
Figure 11A:
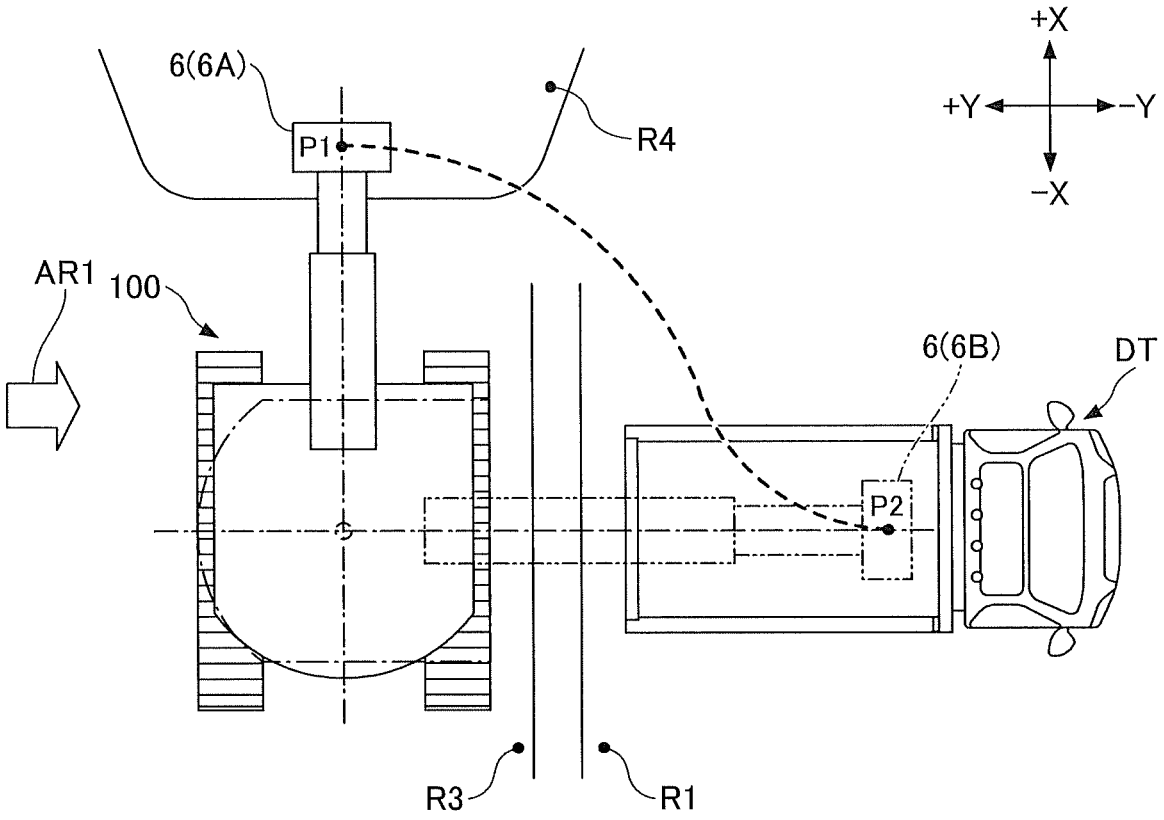
FIGS. 11A and 11B are schematic diagrams illustrating another example of a situation in a work site when a loading work for loading earth onto a dump truck is performed by a shovel.
Figure 11B:
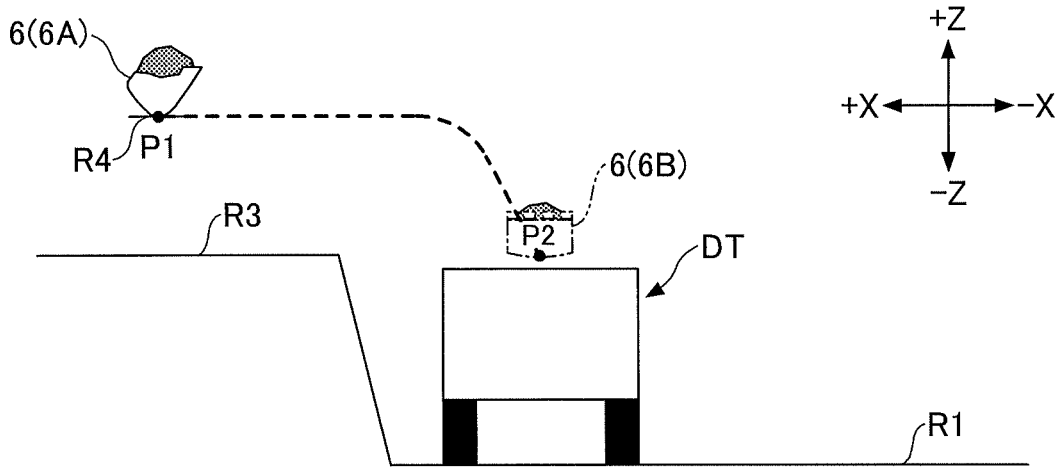

Hereinafter, an example of operation of the shovel 100 according to the present embodiment is explained with reference to FIGS. 10A, 10B, 11A, and 11B. FIGS. 10A and 10B are schematic diagrams illustrating an example of a situation of a work site in which the shovel 100 is performing loading work to load earth (load) to a dump truck DT. FIGS. 11A and 11B are schematic diagrams illustrating another example of a situation of a work site in which the shovel 100 is performing loading work to load earth (load) to the dump truck DT. Specifically, FIG. 10A is a top view illustrating the work site. FIG. 10B is a drawing of the work site as seen from the direction indicated by an arrow AR1 in FIG. 10A. FIG. 11A is a top view illustrating a work site. FIG. 11B is a drawing of the work site as seen from the direction indicated by an arrow AR1 in FIG. 11A. For the sake of clarity, in FIG. 10B and FIG. 11B, the shovel 100 is not illustrated (only the bucket 6 is illustrated). In FIG. 10A and FIG. 11A, the shovel 100 drawn with solid lines represents the state when the excavation operation is finished, and the shovel 100 drawn with alternate long and two short dashes lines represents the state before the unloading operation is started. Likewise, in FIG. 10B and FIG. 11B, a bucket 6A drawn with a solid line represents the state of the bucket 6 when the excavation operation is finished, and a bucket 6B drawn with an alternate long and two short dashes line represents the state of the bucket 6 before the unloading operation is started. Thick broken lines in FIGS. 10A, 10B, 11A, and 11B represent traces of a predetermined or given point of the back surface of the bucket 6. In FIGS. 10A, 10B, 11A, and 11B, the center line of the attachment is indicated by an alternate long and short dash line.

First, at an excavation position indicated as a point P1, the shovel 100 excavates earth with the bucket 6 by controlling the attachment (excavation operation). Next, the shovel 100 turns the upper turning body 3 (in a clockwise direction in the examples of FIG. 10A and FIG. 11A), and accordingly, the bucket 6 is moved from the excavation position indicated as the point P1 to the unloading position indicated as the point P2 (turning operation). The dump bed of the dump truck DT is arranged below the unloading position. Next, at the unloading position, the shovel 100 unloads the earth carried in the bucket 6 to the dump bed of the dump truck DT (unloading operation) by controlling the attachment to unload the earth carried in the bucket 6. Next, the shovel 100 turns the upper turning body 3 (in a counterclockwise direction in the examples of FIG. 10A and FIG. 11A), and accordingly, the bucket 6 is moved from the unloading position indicated as the point P2 to the excavation position indicated as the point P1 (turning operation). By repeating these operations, the shovel 100 loads the excavated earth to the dump bed of the dump truck DT.

In this case, in the example of operation as illustrated in FIGS. 10A and 10B, the shovel 100 excavates a ground contact surface R1 on which the shovel 100 and the dump truck DT rest. As a result, an excavation surface R2 is at a position lower than the ground contact surface R1. The excavation position indicated by the point P1 is at a position lower than the ground contact surface R1. In the example of operation as illustrated in FIGS. 10A and 10B, the turning angle θ of the upper turning body 3 from the excavation position indicated as the point P1 to the unloading position indicated as the point P2 is of small value (for example, 45 degrees) as illustrated in FIG. 10A. In the example of operation as illustrated in FIGS. 10A and 10B, when the bucket 6 is raised substantially vertically from the point P1, and the bucket 6 reaches a position higher than the dump truck DT, the bucket 6 is moved substantially horizontally, as illustrated in FIG. 10B. Therefore, the turning time of the upper turning body 3 is short, and accordingly, the second weight calculation unit 612 may not be able to appropriately calculate the earth weight.

In the example of the operation of the shovel 100 as described above, the boom raising time tb is longer than the predetermined or given threshold time $t_1$. Therefore, the switch determination unit 614 determines that the earth weight can be calculated while the boom 4 is being raised. In other words, the switch determination unit 614 switches to the mode for calculating the earth weight while the boom 4 is being raised, and adopts the earth weight calculated by the first weight calculation unit 611 as the earth weight that is output by the load weight calculation unit 61. It should be noted that, in a section in which the bucket 6 is raised substantially vertically from the point P1, the boom raising operation is mainly performed. Even if complex operation including both of the turning operation and the boom raising operation is performed, the influence of the turning operation is small.

In the example of operation as illustrated in FIGS. 11A and 11B, a ground contact surface R3 of the shovel 100 is arranged at a position higher than the ground contact surface R1 on which the dump truck DT rests. An excavation surface R4 is also at a position higher than the ground contact surface R3. Therefore, the difference in the height between the excavation position indicated as the point P1 and the unloading position indicated as the point P2 is small. Accordingly, the boom raising time is short, and the first weight calculation unit 611 may not be able to appropriately calculate the earth weight. In the example of operation as illustrated in FIGS. 11A and 11B, on the other hand, the turning angle θ of the upper turning body 3 from the excavation position indicated as the point P1 to the unloading position indicated as the point P2 is sufficiently secured as illustrated in FIG. 11A. Also, in the example of operation as illustrated in FIGS. 11A and 11B, the bucket 6 is moved from the point P1 in a substantially horizontal direction, and when the bucket 6 comes to above the dump truck DT, the bucket 6 is lowered, as illustrated in FIG. 11B.

In the example of the operation of the shovel 100 as described above, the switch determination unit 614 may determine to calculate the earth weight while the upper turning body 3 is being turned. In other words, the switch determination unit 614 switches to a mode for calculating the earth weight while the upper turning body 3 is being turned, and adopts the earth weight calculated by the second weight calculation unit 612 as the earth weight that is output by the load weight calculation unit 61. It should be noted that, in a section in which the bucket 6 is moved substantially horizontally from the point P1, the turning operation is mainly performed. Even if complex operation including both of the turning operation and the boom lowering operation is performed, the influence of the boom lowering operation is small.

In the manner as described above, with the shovel 100 according to the present embodiment, the mode for the detection timing is switched according to the operation of the shovel 100, the earth weight is calculated according to the switched mode. In other words, the switch determination unit 614 switches the weight calculation unit for calculating the earth weight (i.e., the first weight calculation unit 611 to the third weight calculation unit 613). Accordingly, the earth weight can be calculated by an appropriate method according to the operation of the shovel 100.

In the shovel 100 according to the present embodiment, the switch determination unit 614 is configured to switch the weight calculation unit (i.e., the first weight calculation unit 611 to the third weight calculation unit 613) according to the operation of the shovel 100. However, the present disclosure is not limited thereto.

For example, the mode for the detection timing may be switched on the basis of a relative position in the operation environment of the shovel 100, and the earth weight may be calculated according to the switched mode. For example, the switch determination unit 614 obtains the earth mound position (i.e., the excavation position) and the position of the dump truck DT (i.e., the unloading position), on the basis of the image captured by the image-capturing device S6. The switch determination unit 614 estimates a trace of the bucket 6 moving from the excavation position to the unloading position, and estimates the boom raising operation time and the turning operation time on the basis of the trace. The switch determination unit 614 may switch the mode for the detection timing according to the processing illustrated in the flowchart of FIG. 9 on the basis of the estimated operation time, and calculate the earth weight according to the switched mode. Accordingly, the earth weight can be calculated by an appropriate method on the basis of the relative position in the operation environment of the shovel 100.

The operator may use the input device 42 to input the mode for the detection timing of earth weight. The switch determination unit 614 may calculate the earth weight according to the switched mode upon switching the mode for the detection timing on the basis of the operator's input. Accordingly, the earth weight can be calculated by an appropriate method on the basis of the operator's input.

According to the above embodiment, a shovel configured to calculate a weight of a load with a high accuracy can be provided.

Although the embodiment and the like of the shovel 100 have been described above, the present invention is not limited to the above-described embodiment and the like, and various modifications and improvements can be made within the scope of the gist of the present invention described in the claims.

What is claimed is:

1. A shovel comprising:

an attachment attached to an upper turning body, the attachment including a boom; and a hardware processor configured to calculate a weight of a load carried in the attachment in accordance with a method of detecting the weight of the load among a plurality of methods of detecting the weight of the load, the plurality of methods of detecting the weight of the load being different in timing of detecting the weight of the load, the plurality of methods of detecting the weight of the load including a first method in which the weight of the load is calculated during turning of the upper turning body and a second method in which the weight of the load is calculated during raising of the boom.

2. The shovel according to claim 1, wherein the hardware processor is configured to compensate a torque for rotating the attachment on the basis of an inertial force and a centrifugal force of the attachment in the second method.

3. The shovel according to claim 1, wherein the hardware processor is configured to switch from operating in one method among the plurality of methods to operating in another method among the plurality of methods, on the basis of an operation state of the shovel.

4. The shovel according to claim 1, wherein the hardware processor is configured to switch from operating in one method among the plurality of methods to operating in another method among the plurality of methods, in response to an input by an operator.

5. A shovel comprising:

an attachment attached to an upper turning body; and a hardware processor configured to calculate a weight of a load carried in the attachment in accordance with a method of detecting the weight of the load among a plurality of methods of detecting the weight of the load, the plurality of methods of detecting the weight of the load being different in timing of detecting the weight of the load, wherein the hardware processor is configured to switch from operating in a first method among the plurality of methods to operating in a second method among the plurality of methods, on the basis of a relative position of a work target of the shovel.

* * * * *